US008113639B2

(12) United States Patent
Kimura et al.

(10) Patent No.: US 8,113,639 B2
(45) **Date of Patent: *Feb. 14, 2012**

(54) LIQUID CONTAINER WITH STRUCTURE FOR CONTROLLING LEAKED LIQUID

(75) Inventors: Hitotoshi Kimura, Nagano-ken (JP); Yasuto Sakai, Nagano-ken (JP); Satoshi Shinada, Nagano-ken (JP); Michinari Tsukahara, Nagano-ken (JP); Masanori Kobayashi, Nagano-ken (JP); Taku Ishizawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 518 days.

This patent is subject to a terminal disclaimer.

(21) Appl. No.: 12/036,754

(22) Filed: Feb. 25, 2008

(65) Prior Publication Data

US 2008/0151020 A1 Jun. 26, 2008

Related U.S. Application Data

(63) Continuation of application No. 10/892,811, filed on Jul. 16, 2004, now Pat. No. 7,452,062.

(30) Foreign Application Priority Data

Jul. 18, 2003 (JP) ..... 2003-199035
Jul. 31, 2003 (JP) ..... 2003-204686
Mar. 26, 2004 (JP) ..... 2004-092012

(51) Int. Cl.
*B41J 2/175* (2006.01)
*B41J 2/17* (2006.01)

(52) U.S. Cl. ..... 347/86; 347/85; 347/84

(58) Field of Classification Search ..... 347/36, 347/84–86

See application file for complete search history.

(56) References Cited

U.S. PATENT DOCUMENTS 4,447,820 A 5/1984 Terasawa
4,640,804 A 2/1987 Mizoguchi
4,695,824 A 9/1987 Tazaki (Continued)

FOREIGN PATENT DOCUMENTS

CN 1242741 1/2000

(Continued)

OTHER PUBLICATIONS

European Search Report from Patent Appln. No. 04016827.0, dated Dec. 1, 2004.

(Continued)

*Primary Examiner* — Stephen Meier
*Assistant Examiner* — Sarah Al Hashimi
(74) *Attorney, Agent, or Firm* — Stroock & Stroock & Lavan LLP

(57) ABSTRACT

Liquid packs provided with liquid leading members are stored in a container case that is constituted by fitting a case main body portion and a lid case in fitting portions and, support portions, which positions the liquid leading members so as to be opposed to liquid introducing members attached to a cartridge inserting portion, are provided on a front surface of the container case, the fitting portions are arranged in a state in which the fitting portions traverses the support portions, and space portions having a gap larger than a gap formed in the fitting portions are formed near the support portions in the fitting portions. In this way, liquid flowing through the fitting portions due to the capillarity is retained by the space portions and never flows to the fitting portions further extending from the space portions.

17 Claims, 13 Drawing Sheets

U.S. PATENT DOCUMENTS

| | | | | |
|---|---|---|---|---|
| 4,719,057 | A | 1/1988 | Mizoguchi | |
| 5,138,344 | A | 8/1992 | Ujita | |
| 5,157,421 | A | 10/1992 | Kitahara | |
| 5,381,172 | A | 1/1995 | Ujita et al. | |
| 5,506,611 | A | 4/1996 | Ujita et al. | |
| 5,523,780 | A | 6/1996 | Hirosawa | |
| 5,666,146 | A | 9/1997 | Mochizuki | |
| 6,053,606 | A | 4/2000 | Yamaguchi | |
| 6,059,402 | A * | 5/2000 | Martens | 347/86 |
| 6,062,667 | A | 5/2000 | Matsui et al. | |
| 6,106,112 | A | 8/2000 | Okubo et al. | |
| 6,264,314 | B1 | 7/2001 | Mochizuki | |
| 6,264,318 | B1 * | 7/2001 | Oda et al. | 347/86 |
| 6,270,210 | B1 | 8/2001 | Yamaguchi | |
| 6,281,911 | B1 | 8/2001 | Nakazawa et al. | |
| 6,283,585 | B1 | 9/2001 | Ikkatai et al. | |
| 6,312,084 | B1 | 11/2001 | Ujita et al. | |
| 6,540,321 | B1 | 4/2003 | Hirano | |
| 6,705,714 | B1 | 3/2004 | Petranek | |
| 6,742,857 | B2 | 6/2004 | Koshikawa et al. | |
| 6,742,872 | B2 | 6/2004 | Fukazawa et al. | |
| 6,755,500 | B2 | 6/2004 | Hirano | |
| 6,783,218 | B2 | 8/2004 | Cheok | |
| 6,793,332 | B2 | 9/2004 | Kaga et al. | |
| 6,832,830 | B2 | 12/2004 | Seino et al. | |
| 6,834,945 | B2 | 12/2004 | Ishizawa et al. | |
| 6,843,558 | B2 | 1/2005 | Seino | |
| 6,874,876 | B2 | 4/2005 | Ishizawa et al. | |
| 6,908,182 | B2 | 6/2005 | Nakazawa et al. | |
| 6,976,746 | B2 | 12/2005 | Shimamura | |
| 7,018,029 | B2 | 3/2006 | Ishizawa et al. | |
| 7,052,121 | B2 | 5/2006 | Yamada | |
| 7,380,909 | B2 | 6/2008 | Ishizawa et al. | |
| 7,452,062 | B2 * | 11/2008 | Kimura et al. | 347/86 |
| 7,566,120 | B2 | 7/2009 | Ishizawa et al. | |
| 2001/0024225 | A1 | 9/2001 | Ishizawa et al. | |
| 2001/0040613 | A1 * | 11/2001 | Nakazawa et al. | 347/86 |
| 2002/0093555 | A1 * | 7/2002 | Kobayashi et al. | 347/86 |
| 2002/0154200 | A1 * | 10/2002 | Miyazawa et al. | 347/86 |
| 2002/0196312 | A1 | 12/2002 | Ishizawa et al. | |
| 2003/0067521 | A1 | 4/2003 | Kaga et al. | |
| 2003/0222940 | A1 | 12/2003 | Seino et al. | |

FOREIGN PATENT DOCUMENTS

| | | | |
|---|---|---|---|
| EP | 0 419 876 | A | 4/1991 |
| EP | 1 122 073 | A2 | 8/2001 |
| EP | 1164025 | A1 * | 12/2001 |
| JP | 52-091319 | | 12/1975 |
| JP | 53-085867 | | 7/1978 |
| JP | 60-159931 | | 10/1985 |
| JP | 60-171834 | | 11/1985 |
| JP | 62-184856 | | 8/1987 |
| JP | 03-045843 | | 4/1991 |
| JP | 03-227650 | | 10/1991 |
| JP | 05-004349 | | 1/1993 |
| JP | 05-016377 | | 1/1993 |
| JP | 05-162333 | | 6/1993 |
| JP | 05-162333 | A | 6/1993 |
| JP | 05-162334 | | 6/1993 |
| JP | 06-008463 | | 1/1994 |
| JP | 07-312211 | | 11/1995 |
| JP | 08-080618 | | 3/1996 |
| JP | 08-230950 | | 10/1996 |
| JP | 10-217499 | | 8/1998 |
| JP | 10-308084 | | 11/1998 |
| JP | 11-070665 | | 3/1999 |
| JP | 11-129491 | | 5/1999 |
| JP | 11-157097 | | 6/1999 |
| JP | 11-176402 | | 7/1999 |
| JP | 2000-006431 | | 1/2000 |
| JP | 2000-238278 | | 9/2000 |
| JP | 2000-296626 | A | 10/2000 |
| JP | 2000-334977 | | 12/2000 |
| JP | 2001-287379 | A | 10/2001 |
| JP | 2001-341323 | | 12/2001 |
| JP | 2001-353882 | | 12/2001 |
| JP | 2002-001979 | | 1/2002 |
| JP | 2002-019135 | | 1/2002 |
| JP | 2002-192738 | | 7/2002 |
| JP | 2003-053984 | | 2/2003 |
| JP | 2003-063573 | | 3/2003 |
| JP | 2003-103796 | | 4/2003 |
| JP | 2003-266724 | | 9/2003 |
| JP | 2002-362643 | | 12/2003 |
| JP | 2004-074801 | | 3/2004 |

OTHER PUBLICATIONS

Partial European Search Report dated Oct. 7, 2004, in EP 04 01 6827.

* cited by examiner 14
31
32
33
32a
32b
32c
32d
33a
33c
27
28
29
30
43
43a
43b
44
44a
45
45e
47
51
L1
(B)
(C)

29
29a
29b
33
33a
33c
45
45a
45b
45c
45d
45e
43b
44b
30
32a
36
69
70

LIQUID CONTAINER WITH STRUCTURE FOR CONTROLLING LEAKED LIQUID

CROSS-REFERENCE TO RELATED APPLICATION

This application is a continuation of application Ser. No. 10/892,811, now U.S. Pat. No. 7,452,062, filed on Jul. 16, 2004.

BACKGROUND OF THE INVENTION

1. Field of the Invention

The present invention relates to a liquid container.

2. Description of the Related Art

As one of liquid ejection apparatuses that eject liquid on a target, an ink-jet type printer is widely used. This ink-jet type printer includes a carriage and a recording head mounted on the carriage. The ink-jet type printer discharges ink from nozzles formed in the recording head to perform printing on a recording medium while moving the carriage with respect to the recording medium. In addition, in such an ink-jet type printer, an ink cartridge serving as a liquid container for storing ink is provided replaceably, and the ink discharged from the recording head is supplied from the ink cartridge.

Incidentally, in recent years, in the ink-jet type printer described above, printing has been performed on a large print sheet such as an AO size sheet. In such a case, since an amount of ink consumption increases, there is a demand for an ink cartridge that can store a large quantity of ink. If such a large capacity ink cartridge is mounted on a carriage, weight of the carriage increases, and it is likely that a great deal of load is applied to a carriage motor or the like. Therefore, a structure in which an ink cartridge is not mounted on a carriage (so-called off-carriage type) has been generally adopted.

In recent years, it has also been proposed to adopt the off-carriage system for an ink-jet type printer, which is reduced in size and thickness, in addition to the large ink-jet type printer described above.

In the off-carriage system described above, ink packs provided with ink leading members are contained in a container case including a case main body portion and a lid case to form an ink cartridge. In the ink packs contained as described above, the ink leading members are positioned by support portions formed on a front surface of the container case. Reception openings are provided in the centers of the support portions such that needle-like ink introducing members (ink supply needles), which are arranged in a cartridge inserting portion on a recording apparatus side, are relatively stuck into the ink leading members through the reception openings (see JP-A-10-217499).

If the ink supply needles remain stuck in the ink leading portions of the ink packs as described above, there is no leakage of ink. On the other hand, when an ink pack is empty, the ink cartridge is detached from the ink cartridge inserting portion and the ink pack is replaced. When the ink cartridge is detached, leakage of ink occurs because surfaces of exposed ink supply needles are wet with ink or a slight amount of ink scatters in a transition period of the detachment of the ink cartridge. If a user repeats such detachment and attachment of the ink cartridge for a more number of times than normal, the ink leaked as described above accumulates to an amount enough for allowing the ink to flow. Then, the ink flows in a gap part between the case main body portion and a fitting portion of the lid case due to the capillarity to reach a place apart from the support portions.

When the user holds and detaches the ink pack from which the ink flow described above has occurred, a hand of the user is smeared with the ink or the ink smear reaches even to the cartridge inserting portion of the apparatus.

Note that the above-mentioned problem is a problem that should be solved not only in the ink-jet type printer of the off-carriage system but also in an ink-jet type printer of a form for inserting an ink cartridge, which is formed by containing ink packs provided with ink leading members in a container case including a case main body portion and a lid case, into a cartridge inserting portion formed in a carriage.

The invention has been devised in order to solve such a problem, and it is an object of the invention to provide a liquid container that can prevent leaked liquid from invading along the liquid container.

In addition, it is another object of the invention to provide a liquid container that can prevent flow of liquid due to the capillarity.

The ink-jet type printer described above has been diversified in that a range of application thereof has been expanded and higher definition print image quality has been demanded. In accordance with the diversification, types of ink used in the ink-jet type printer have also been diversified, and for example, a cartridge is replaced according to contents of printing, and the printing is executed. In the ink-jet type printer in which an operation for replacing an ink cartridge according to contents of printing is performed, an ink cartridge provided with information on ink is required. Thus, proposals have been made for an ink cartridge mounted with semiconductor storing means that is capable of reading out and writing data in order to manage types of ink and a remaining amount of ink in the ink cartridge (see JP-A-2002-1979 and JP-A-2002-19135).

In addition, a proposal has been made for an ink cartridge that includes, in addition to a circuit board storing ink information, an ink pack serving as a bag for ink and a waste ink collector for collecting waste ink such that printing according to a characteristic of ink can be performed surely (see Japanese Patent No. 3222454).

However, the ink cartridge has a problem in that, since the circuit board is close to a position to which ink is supplied and a position from which the ink is discharged, the ink adheres to the circuit board due to scattering, dripping, or the like of the ink. More specifically, the scattering, the dripping or the like of the ink is caused from an ink supply port for supplying the ink or a waste ink collecting port for collecting waste ink when the ink cartridge is attached to and detached from a printer body. Therefore, when the scattering, the dripping, or the like of the ink occurs, the ink adheres to the circuit board that is provided in a position adjacent to the ink supply port or the waste ink collecting port.

The invention has been devised in order to solve the problem, and it is an object of the invention to provide a liquid container that does not affect an electronic device even in the case in which ink drips or scatters from a liquid supply port or a liquid collecting port.

SUMMARY OF THE INVENTION

The gist of a liquid container of the invention is that a liquid containing portion, which includes a liquid leading member for leading stored liquid, is contained in a container case formed by fitting a case main body portion and a lid case, a support portion for fixing the liquid leading member is provided on a front surface of the container case, fitting portions of the case main body portion and the lid case are arranged in a state in which the fitting portions traverse the support portion, and a space portion having a gap larger than a gap formed in the fitting portions is formed near the support portion in the fitting portions.

Even if liquid, which has flown out from a place where a liquid introducing member on a cartridge inserting portion side and the liquid leading member on the liquid container side are joined, flows through the fitting portions due to the capillarity, the liquid is stored in the space portion in the form of the gap larger than the gap of the fitting portions. Even in this storing phenomenon, the liquid takes on the capillarity in the gap part having an enlarged space volume to come into a state in which the liquid is held in the space portion. Therefore, the flow of the liquid through the fitting portions is stopped in the place of the space portion, and the liquid flow to the fitting portions extending further from the space portion is prevented. According to such a phenomenon of prevention of the flow of the liquid, liquid smear of the liquid container can be controlled to be within a minimum range. In addition, when the liquid container is attached to and detached from the cartridge inserting portion, a hand is prevented from being smeared with the liquid.

In the liquid container of the invention, in the case in which the space portion are provided between an end of the front surface of the container case and the support portion present in a place closest to the end, the flow of the liquid through the fitting portions is prevented in the space portion arranged within a range of the front surface of the container case. Therefore, the liquid can be prevented from flowing to, for example, a place on a lateral side surface of the container case exceeding the range of the front surface.

In the liquid container of the invention, in the case in which the space portions are provided near both ends of the front surface of the container case, respectively, even in a structure in which a plurality of the support portions are arranged on the front surface of the container case, flow of the liquid near both the ends of the front surface is prevented, and the liquid is prevented from flowing to, for example, the place on the lateral side surface of the container case exceeding the range of the front surface.

In the liquid container of the invention, in the case in which a plurality of the support portions are provided to form a line and plural liquid packs are contained in the liquid container correspondingly to the respective support portions, since the liquid leading members of the plural liquid packs contained in the container case are positioned by the arranged support portions, the plural liquid packs come into a state in which the liquid packs are arranged regularly in the container case, loads of the other liquid packs never concentrate on a specific liquid pack, and liquid supply from the respective liquid packs can be made uniform. At the same time, even in the case in which plural kinds of liquid have leaked, liquid flow along the fitting portions can be prevented in the space portions.

In the liquid container of the invention, in the case in which the space portions are provided on both sides of the support portion, respectively, the space portions are arranged in places closer from the support portion, whereby a flowing range of liquid flowing through the fitting portions can be reduced to a minimum limit.

In the liquid container of the invention, in the case in which a fitting direction of the fitting portions is set in substantially a depth direction of the case main body portion, and a gap dimension of the space portion is set to be larger than a gap dimension of the fitting portions as viewed in the fitting direction, since a gap of the space portion can be secured in the fitting direction, an arrangement of the space portion suitable for a fitting structure of the fitting portions becomes possible.

In the liquid container of the invention, the fitting direction of the fitting portions is set in substantially the depth direction of the case main body portion, and a gap dimension of the space portion is set to be larger than a gap dimension of the fitting portions as viewed in a direction substantially perpendicular to the fitting direction, since a gap of the space portion can be secured in a direction perpendicular to the fitting direction, an arrangement of the space portion suitable for the fitting structure of the fitting portions becomes possible.

In the liquid container of the invention, in the case in which the space portion is formed as a recess provided in a part of the case main body portion and/or the lid case in the fitting portions, a degree of freedom of recess formation with respect to the case main body portion or the lid case is increased, whereby optimum formation of the space portion according to a behavior of the liquid flowing in the fitting portions can be performed.

In the liquid container of the invention, in the case in which the space portion is formed as a pierced portion provided in a wall member forming a part of the fitting portions, a function of retaining the liquid can be imparted to a space formed by the pierced portion, and formation of the space portion can be performed under a high degree of freedom according to a flowing behavior of the liquid.

In the liquid container of the invention, in the case in which the support portion is constituted by fitting a lower support portion formed on the case main body portion side and an upper support portion formed on the lid case side, a reception opening is formed in a front surface part of the support portion to receive a liquid introducing member, and the fitting portions are arranged so as to traverse the reception opening, the support portion and the reception opening are formed by mating the lid case with the case main body portion. Thus, this is effective for simplification of a structure. In addition, the fitting portions, which are secants of the case main body portion and the lid case, traverse the reception opening. Thus, the fitting portions are present near a place where the liquid scatters in a form of spray, the liquid can be flown through the fitting portions surely, and as a result, the flow can be prevented in the space portion leading to the fitting portions.

A liquid container of the invention includes a circuit board, which mounts thereon storing means that stores liquid information, and a waste liquid collecting portion, which collects waste liquid from a liquid ejection apparatus, and is mounted on the liquid ejection apparatus detachably, in which a waste liquid collecting port in communication with the waste liquid collecting portion is formed at one end on a side surface of the liquid container, and the circuit board is disposed at the other end on the side surface on the opposite side of the waste liquid collecting port.

According to this liquid container, the waste liquid collecting port and the circuit board are spaced apart from each other. This makes it possible to arrange the circuit board such that, even in the case in which waste liquid leaks from the waste liquid collecting port, the leaked waste liquid does not reach the circuit board. Therefore, the liquid container, in which the circuit board is not affected, can be obtained.

In this liquid container, the circuit board is disposed in an inner surface of an accommodating recess that is recessed from the side surface and that is located on a bottom surface of the case main body, which constitutes the liquid container.

The circuit board is attached to a surface perpendicular to a surface where the waste liquid collecting port is formed in the case main body. This makes it possible to arrange the circuit board such that, even in the case in which liquid leaks, the leaked liquid does not reach the circuit board. Therefore, the liquid container, in which the circuit board is not affected, can be obtained.

In this liquid container, the liquid container includes a liquid containing bag containing liquid, a supply port for supporting a leading member of the liquid containing bag is provided in the center of the side surface, and the circuit board is disposed in a position equal to or higher than a central axis of the supply port in a posture in which the circuit board is mounted on and used by the liquid ejection apparatus.

A position of the circuit board is set at the same height as the central axis of the supply port or higher than that. This makes it possible to arrange the circuit board such that, even in the case in which liquid leaks, the leaked liquid does not reach the circuit board. Therefore, the liquid container, in which the circuit board is not affected, can be obtained.

In this liquid container, the liquid container includes plural liquid containing bags, supply ports for supporting leading members of the plural liquid containing bags are provided in the center of the side surface, respectively, and the circuit board is disposed in a position equal to or higher than the central axis of each of the supply ports in a posture in which the circuit board is mounted on and used by the liquid ejection apparatus.

A position of the circuit board is set at the same height as the central axis of each of the supply ports or higher than that. This makes it possible to arrange the circuit board such that, even in the case in which liquid leaks from each of the supply ports, the leaked liquid does not reach the circuit board. Therefore, the liquid container, in which the circuit board is not affected, can be obtained.

In this liquid container, the liquid containing bag is constituted by welding four sides of two flexible films.

Since the four sides of the two flexible films are welded, the liquid containing bag has a structure in which liquid does not leak to the outside. Therefore, the liquid container, in which the circuit board is not affected, can be obtained.

In this liquid container, positioning holes, into which positioning pins provided in the liquid ejection apparatus are fit and inserted when the liquid container is mounted on the liquid ejection apparatus, are provided on the side surface near the circuit board and near the waste liquid collecting port, respectively.

Since a positioning mechanism at the time of mounting the liquid container on the liquid ejection apparatus is provided near the circuit board and near the waste liquid collecting port of the liquid container, a balance of load in mounting the liquid container on the apparatus is made uniform. Therefore, the liquid container can be mounted stably while a direction of mounting the liquid container is kept constant. In addition, the circuit board and a connection terminal portion on the main body side can be connected accurately.

A liquid container of the invention includes storing means that stores liquid information, a connection terminal that is connected to the storing means and to be connected to a terminal formed in a liquid ejection apparatus, and a waste liquid collecting portion that collects waste liquid from the liquid ejection apparatus, and is mounted on the liquid ejection apparatus detachably, in which a waste liquid collecting port in communication with the waste liquid collecting portion is formed at one end of a side surface of the liquid container, and the connection terminal is provided at the other end of the side surface on the opposite side of the waste liquid collecting port.

According to this liquid container, the waste liquid collecting port and the connection terminal are spaced apart from each other. This makes it possible to arrange the connection terminal such that, even in the case in which waste liquid leaks from the waste liquid collecting port, the leaked waste liquid does not reach the connection terminal. Therefore, the liquid container, in which the connection terminal is not affected by adhesion of waste liquid, can be obtained.

In the liquid container, the connection terminal is formed on an inner surface of an accommodating recess that is recessed from the side surface and that is located on a bottom surface of the case main body, which constitutes the liquid container.

The connection terminal is attached to a surface perpendicular to a surface where the waste liquid collecting port is formed in the case main body. This makes it possible to arrange the connection terminal such that, even in the case in which liquid leaks, the leaked liquid does not reach the connection terminal. Therefore, the liquid container, in which the connection terminal is not affected by adhesion of liquid, can be obtained.

In this liquid container, positioning holes, into which positioning pins provided in the liquid ejection apparatus are fit and inserted when the liquid container is mounted on the liquid ejection apparatus, are provided on the side surface near the connection terminal and near the waste liquid collecting port, respectively.

Since a positioning mechanism at the time of mounting the liquid container on the liquid ejection apparatus is provided near the connection terminal and near the waste liquid collecting port of the liquid container, a balance of load in mounting the liquid container on the apparatus is made uniform. Therefore, the liquid container can be mounted stably while a direction of mounting the liquid container is kept constant. In addition, the connection terminal and a terminal portion on the main body side can be connected accurately.

The present disclosure relates to the subject matter contained in Japanese patent application No. 2003-199035 (filed on Jul. 18, 2003), 2003-204686 (filed on Jul. 31, 2003) and 2004-092012 (filed on Mar. 26, 2004), each of which is expressly incorporated herein by reference in its entirety.

BRIEF DESCRIPTION OF THE DRAWINGS

In the accompanying drawings:

FIG. 13A is a perspective view showing a formed state of another space portion; and FIGS. 13A to 13D are sectional views showing the formed state of another space portion.

DESCRIPTION OF THE PREFERRED EMBODIMENTS

Next, a best mode for carrying out the liquid container of the present invention will be explained.

First Embodiment

FIG. 1A is a conceptual diagram of an ink-jet type printer (hereinafter referred to as printer) serving as a liquid ejection apparatus, and FIG. 1B is a simple perspective view showing an overall shape of the printer. Note that the printer of the embodiment is a printer of an off-carriage type that is not mounted with an ink cartridge serving as a liquid container on a carriage, which is a small and thin printer with a degree of freedom given to a layout of the ink cartridge.

Figure 1:
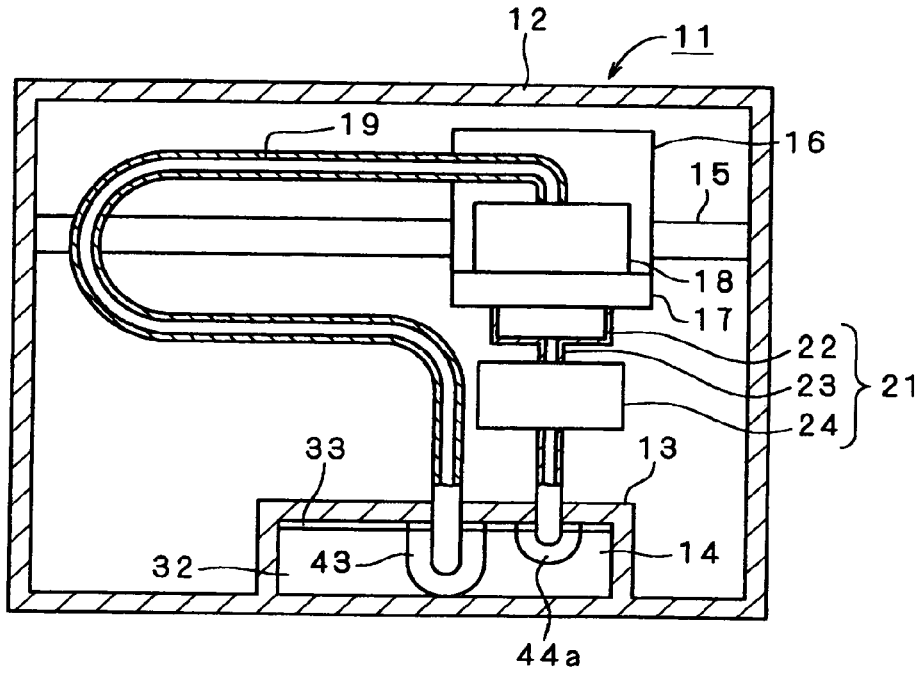
FIG. 1A is a conceptual diagram of an ink-jet type printer.
FIG. 1B is a perspective view of the ink-jet type printer.
Figure 1:
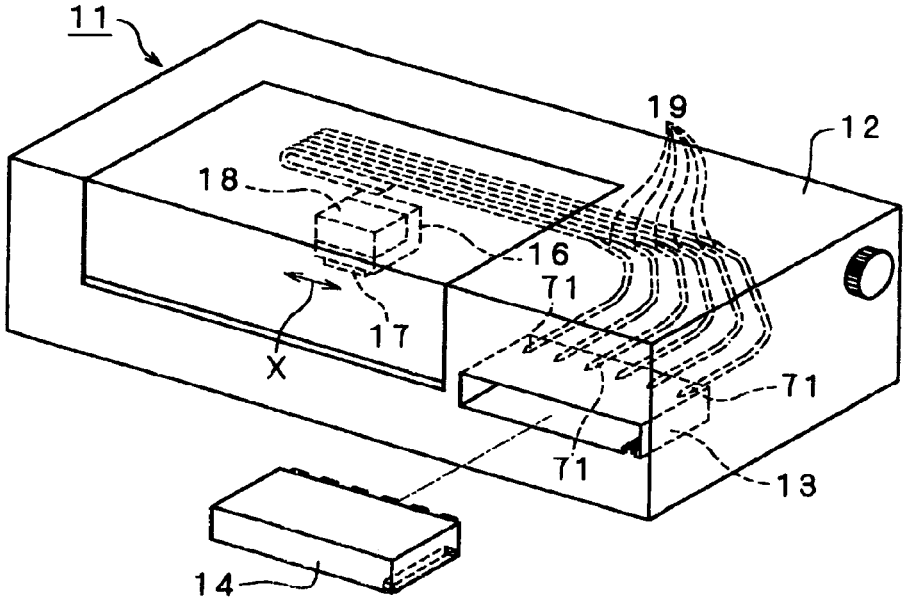

As shown in FIG. 1, a printer 11 includes a frame 12, and a cartridge inserting portion 13 is formed in a lower part of the frame 12. An ink cartridge 14 serving as a liquid container is detachably inserted in this cartridge inserting portion 13. Note that this ink cartridge 14 is capable of storing ink as liquid and storing waste ink as waste liquid. Details of the ink cartridge 14 will be described later.

The printer 11 includes a guide member 15, and the guide member 15 is suspended in the frame 12. A carriage 16 is inserted and supported to be movable in an axial direction of the guide member 15. The carriage 16 is connected to a carriage motor (not shown) via a timing belt (not shown) and reciprocates in a direction of arrow X (see FIG. 1B), which is a main scanning direction, along the guide member 15 according to driving of the carriage motor.

A recording head 17 serving as a liquid ejection head is provided on a lower surface of the carriage 16. In addition, a sub-tank 18 is mounted on the carriage 16. One end of an ink supply tube 19, which is formed of a flexible member such as polyethylene, is connected to this sub-tank 18. The other end of the ink supply tube 19 is connected to the ink cartridge 14. Therefore, the sub-tank 18 receives supply of ink from the ink cartridge 14 via the ink supply tube 19. Note that it is desirable that the ink supply tube 19 has a double structure in which an interior formed of a flexible member such as polyethylene resin excellent in chemical resistance is covered by vinyl chloride, a metal film, or the like excellent in airtightness serving as an armor.

In addition, the sub-tank 18 is connected to the recording head 17 and supplies ink supplied from the ink cartridge 14 to the recording head 17. The recording head 17 includes a not-shown nozzle discharge port on a lower surface thereof and discharges ink supplied from the sub-tank 18 from the nozzle discharge port as ink droplets according to driving of a not-shown piezoelectric element. Then, the carriage 16 is caused to reciprocate with respect to a print sheet (not shown) as a target simultaneously with discharging the ink from the nozzle discharge port. This makes it possible to perform printing on a print sheet.

Note that, when the carriage 16 reciprocates along the guide member 15, the ink supply tube 19 bends accordingly, and pressure fluctuation occurs in the ink in the ink supply tube 19. However, this pressure fluctuation is absorbed by the sub-tank 18. In other words, the sub-tank 18 functions as a pressure damper unit. Therefore, the ink discharged from the recording head is in a state in which the pressure fluctuation is controlled.

In the conceptual diagram of the printer 11 shown in FIG. 1A, for convenience of explanation, only one ink supply tube 19 is shown. However, actually, as shown in FIG. 1B, the ink supply tubes 19 are provided in the same number as the number of ink packs 3 of respective colors that are one of liquid containing portions contained in the ink cartridge 14. Therefore, nozzles of the recording head 17 and the sub-tanks 18 are also provided in association with the ink packs 34 of the respective colors.

On the other hand, a head maintenance mechanism 21, which can seal the nozzle discharge port of the recording head 17, is arranged in a non-print area (home position) on a moving path of the carriage 16. The head maintenance mechanism 21 includes a cap member 22 formed of an elastic material such as rubber with a bottom. The cap member 22 can cover and seal the nozzle discharge ports of the recording head with an upper opening thereof. When the carriage 16 moves to the home position, the head maintenance mechanism 21 moves (rises) to the recording head 17 side such that the nozzle discharge port of the recording head 17 can be covered by the cap member 22.

This cap member 22 functions as a cap that covers the nozzle discharge ports of the recording head 17 during a suspension period of the printer 11 to prevent drying of the nozzle discharge ports. The head maintenance mechanism 21 includes a waste ink tube 23, and the waste ink tube 23 is connected to a bottom of the cap member 22 at one end thereof and connected to the ink cartridge 14 at the other end. Further, the head maintenance mechanism 21 includes a suction pump 24 in the middle of the waste ink tube 23 and drives the suction pump 24 to thereby decompress the inside of the cap member 22 located further on the upstream side than the suction pump 24. The inside of the cap member 22 is decompressed in a state in which the cap member 22 covers the nozzle discharge ports of the recording head 17. This makes it possible to execute a cleaning operation for sucking ink from the nozzle discharge ports of the recording head 17.

The ink sucked from the nozzle discharge ports of the recording head 17 is discharged to the ink cartridge 14 via the waste ink tube 23. Note that, in this embodiment, as shown in FIG. 1, the home position is located on the right of the cartridge inserting portion 13.

Figure 4:
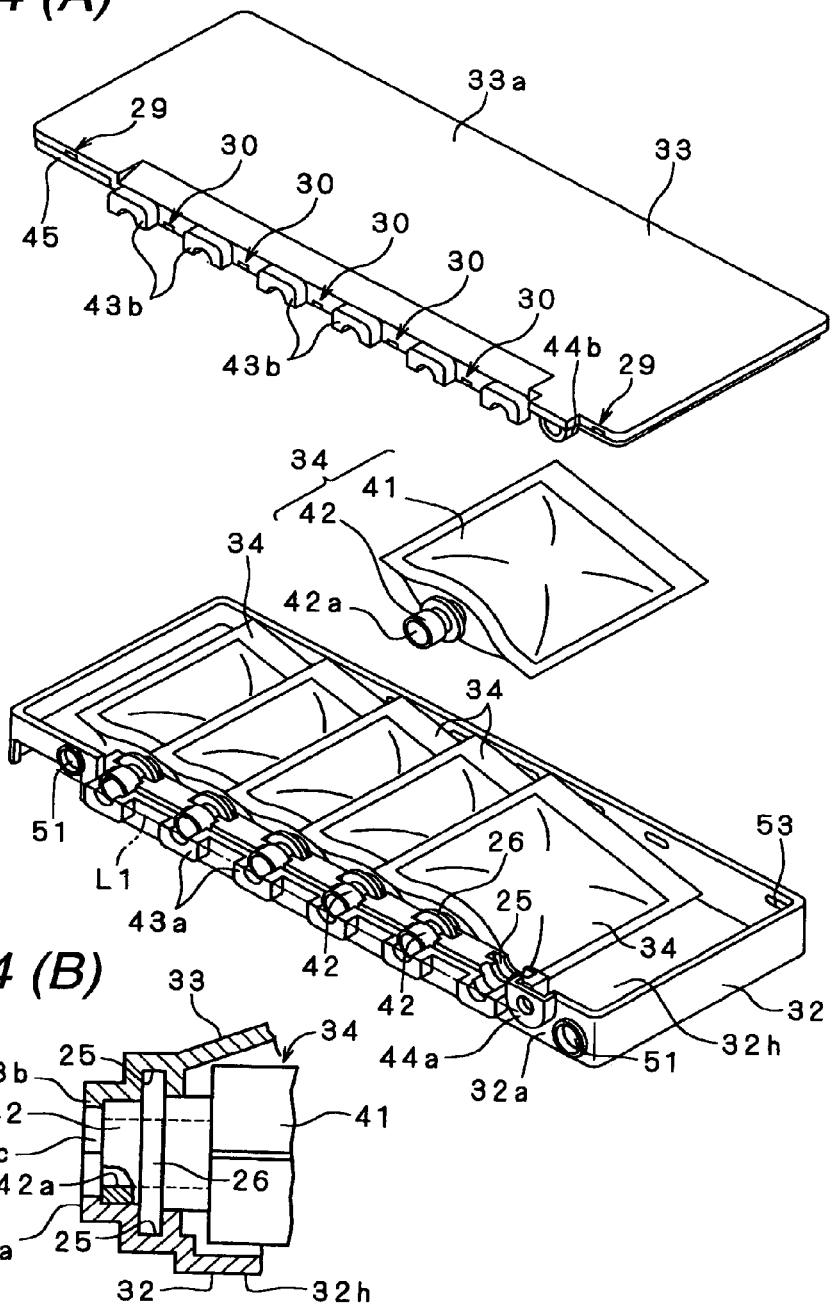
FIG. 4A is a disassembled perspective view of the ink cartridge.
FIG. 4B is a partial sectional view of the ink cartridge.
Figure 4:
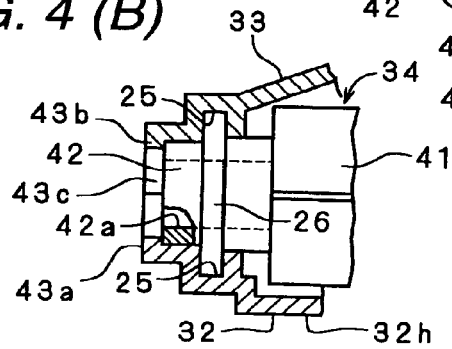

Next, the ink cartridge 14 to be inserted in the cartridge inserting portion 13 will be explained. As shown in FIG. 2A, the ink cartridge 14 has a flat and substantially a rectangular parallelepiped shape. The ink cartridge 14 includes a container case 31, which has a case main body portion 32 and a lid case 33, and plural ink packs 34 (see FIG. 4A) contained in the container case 31.

As shown in FIG. 4A, the ink pack 34 includes a bag portion 41 and an ink leading member 42. The bag portion 41 is formed of a flexible material. For improvement of a gas barrier property, the bag portion 41 is formed of, for example, aluminum laminate films of a structure in which the outside thereof is covered by a nylon film and the inside thereof is covered by a polyethylene film. The bag portion 41 is formed by laying these two substantially rectangular aluminum laminate films one on top of another and joining peripheries thereof by a method such as thermal fusion welding. The bag portion 41 stores ink in the inside.

The ink leading member 42 is formed of, for example, plastics in a substantially cylindrical shape, and the inside thereof forms an ink supply port 42*a*. The ink stored in the ink pack 34 is taken out via this ink supply port 42*a*. In addition, a not-shown valve mechanism, which is opened only at the time when the ink is supplied, is provided in the ink supply port 42*a* such that the ink inside the bag portion 41 does not leak.

Figure 2:
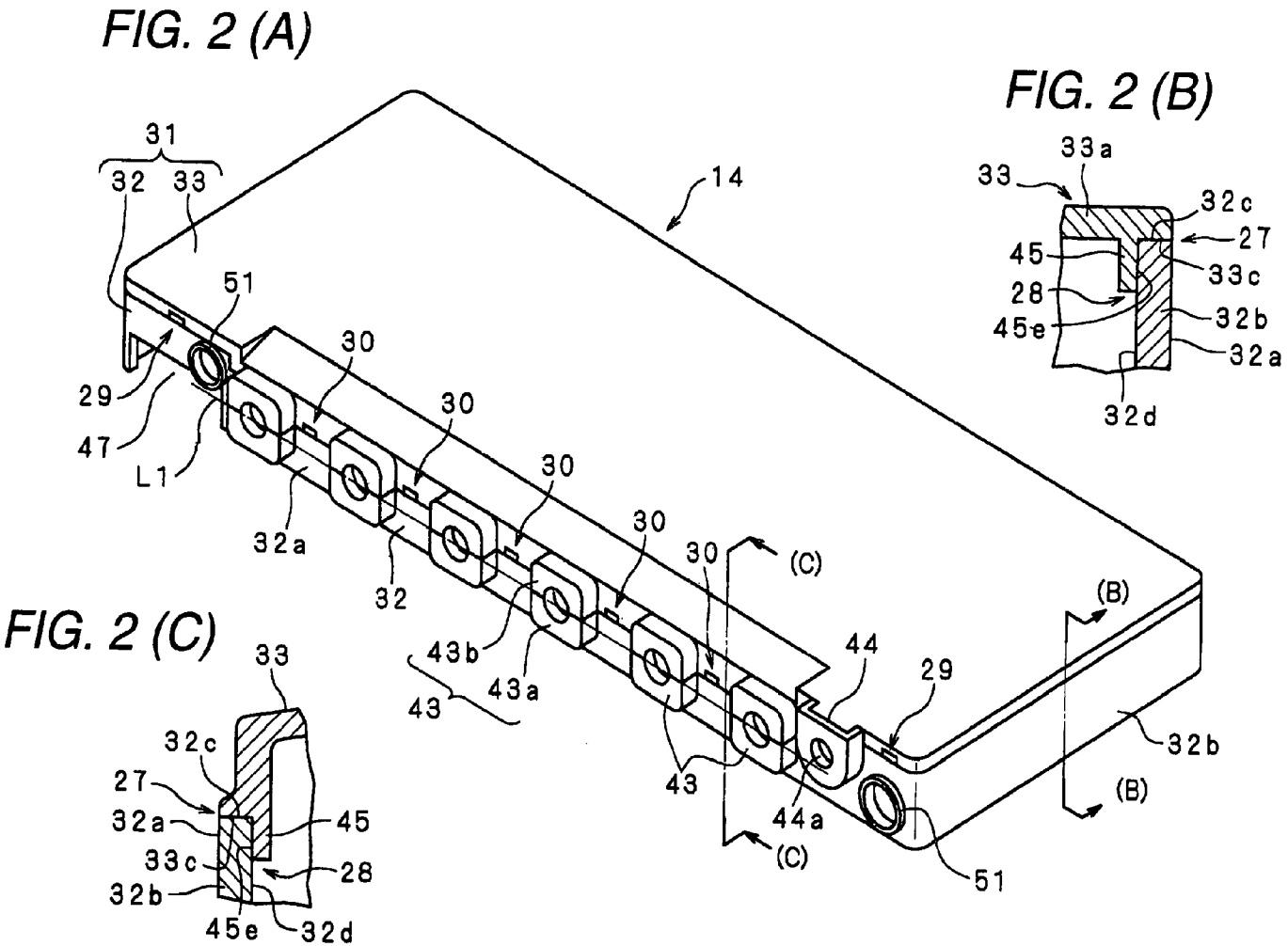
FIG. 2A is a perspective view of an ink cartridge viewed from above.
FIGS. 2B and 2C are partial sectional views of the ink cartridge.

As shown in FIG. 2, the container case 31 includes the case main body portion 32 of substantially a box shape having an opening at the top and the lid case 33 of substantially a plate shape covering the opening of the case main body portion 32. Six support portions 43, which are present in the same number as the number of the ink packs 34 to be contained, are provided in the center of a front surface 32*a* of the container case 31 (front surface of the case main body portion 32). The six support portions 43 are provided in line such that the respective centers thereof are located on a central line L1 parallel with a bottom surface 32*h* of the container case 31 (bottom surface of the case main body portion 32) and are provided in substantially the center in the vertical direction of the case main body portion 32. In other words, secants forming fitting portions of the case main body portion 32 and the lid case 33 traverse the centers of the support portions 43.

As shown in FIGS. 2A to 2C, FIG. 3, and FIGS. 4A and 4B, the vertical direction in the figures is set as a depth direction of the case main body portion 32. The container case 31 is formed in a state in which the lid case 33 fits in and matches with the case main body portion 32. In other words, as shown in FIG. 2B, which is a sectional view along line (B)-(B) in FIG. 2A, and FIG. 2C, which is a sectional view along line (C)-(C) in FIG. 2A, a top surface 32*c*, which is one abutment surface, is provided on a sidewall plate 32*b* of the case main body portion 32. In addition, a lower surface 33*c*, which is another abutment surface, is provided in a peripheral part of a plate-like portion 33*a* of the lid case 33. An inner surface 32*d* of the sidewall plate 32*b* is set as one sliding abutment surface, and an outer surface 45*e* of an inner frame portion 45, which is formed in a state in which the inner frame portion 45 is erected along the vicinity of an outer periphery of the lid case 33, is set as another sliding abutment surface. Note that the inner frame portion 45 is set as a wall member forming a part of fitting portions.

As shown in FIG. 4A, in the support portion 43, a lower support portion 43*a* forming a lower half of the support portion 43 is provided in the case main body portion 32, and an upper support portion 43*b* forming an upper half of the support portion 43 is provided in the lid case 33. The support portions 43 support the ink leading members 42 of the respective ink packs 34. Therefore, when the lid case 33 is attached in a state in which the ink leading members 42 of the ink packs 34 are supported by the lower support portions 43*a* of the case main body portion 32, the lower and the upper support portions 43*a* and 43*b* fit to each other, whereby the support portions 43 are formed. In other words, the fitting portions of the case main body portion 32 and the lid case 33 traverse the support portions 43.

Note that, in this embodiment, the six support portions 43 are provided at an equal interval, and the ink packs 34 supported by the support portions 43 are arranged such that one is laid on top of another at an equal interval.

As shown in FIGS. 4A and 4B and FIGS. 5A and 5B, semi-arcuate projected rim portions 26 formed in a flange shape, which are provided in outer peripheries of the ink leading members 42, are fit in semi-arcuate groove portions 25, which are provided in the lower support portions 43*a* and the upper support portions 43*b* of the support portions 43, respectively. Positioning for the ink leading members 42 is performed by the support portions 43.

As shown in FIG. 4B, a reception opening 43*c* for receiving an ink supply needle 71 is provided in the front part of the support portion 43. This reception opening 43*c* is formed by mating a semicircular cutout portion 43*d* (see FIG. 10A), which is formed in the lower support portion 43*a*, and a semicircular cutout portion 43*e* (see FIG. 10B), which is formed in the upper support portion 43*b*, in the fitting portions. The reception opening 43*c* and the ink supply port 42*a* of the ink leading member 42 are arranged concentrically. Note that the reception opening 43*c* and the ink supply portion 42*a* are circular.

As shown in FIG. 2A, a waste ink collecting port 44*a* serving as a waste liquid collecting port for collecting waste ink is provided on the right of the front surface 32*a* of the case main body portion 32. A waste ink introducing portion 44*b* of the lid case 33 can be fitted to the waste ink collecting port 44*a* (see FIG. 4). By fitting the waste ink introducing portion 44*b* in the waste ink collecting port 44*a* of the case main body portion 32, the waste ink introducing portion 44*b* and the waste ink collecting port 44*a* communicate with each other.

Figure 3:
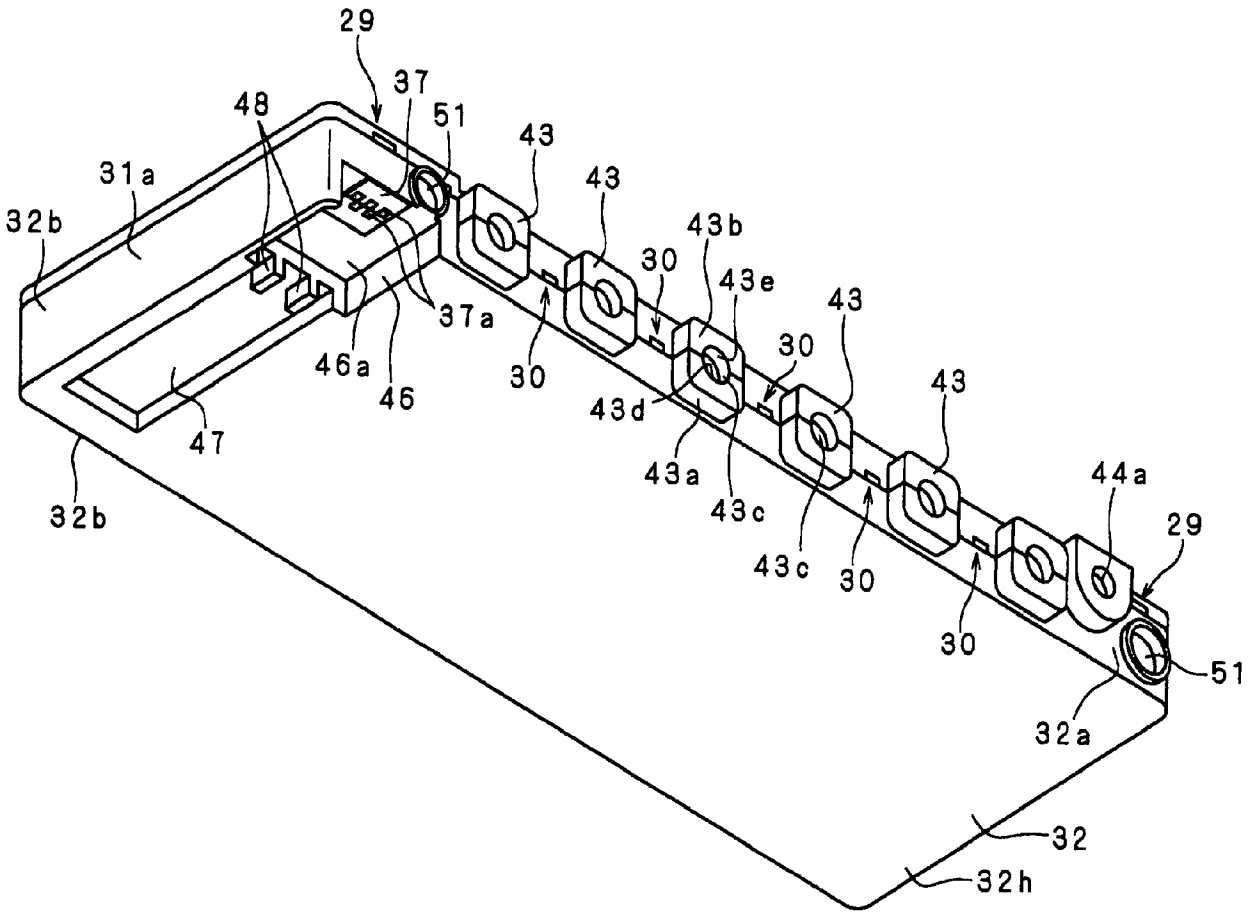
FIG. 3 is a perspective view of the ink cartridge viewed from below.

Two positioning holes 51 are provided near both ends of the front surface 32*a* of the case main body portion 32. Further, as shown in FIG. 3, a board accommodating recess 46 is recessed on the left of the bottom surface 32*h* of the case main body portion 32 so as to communicate with the front surface 32*a*. A circuit board 37 is attached to an inner surface 46*a* of the board accommodating recess 46. In this embodiment, the circuit board 37 is provided so as to be located in the same position as the center line L1 of the support portions 43 where the ink packs 34 are supported or above the center line L1 according to a shape of the board accommodating recess 46. Connection terminals 37*a* are formed on the front surface side of the circuit board 37. The connection terminals 37*a* are electrically connected to a semiconductor storage device (not shown) capable of writing and reading data mounted on the circuit board 37. The semiconductor storage device stores data such as types, remaining amounts, serial numbers, and usable periods of inks in the respective ink packs 34 contained in the container case 31.

Figure 6:
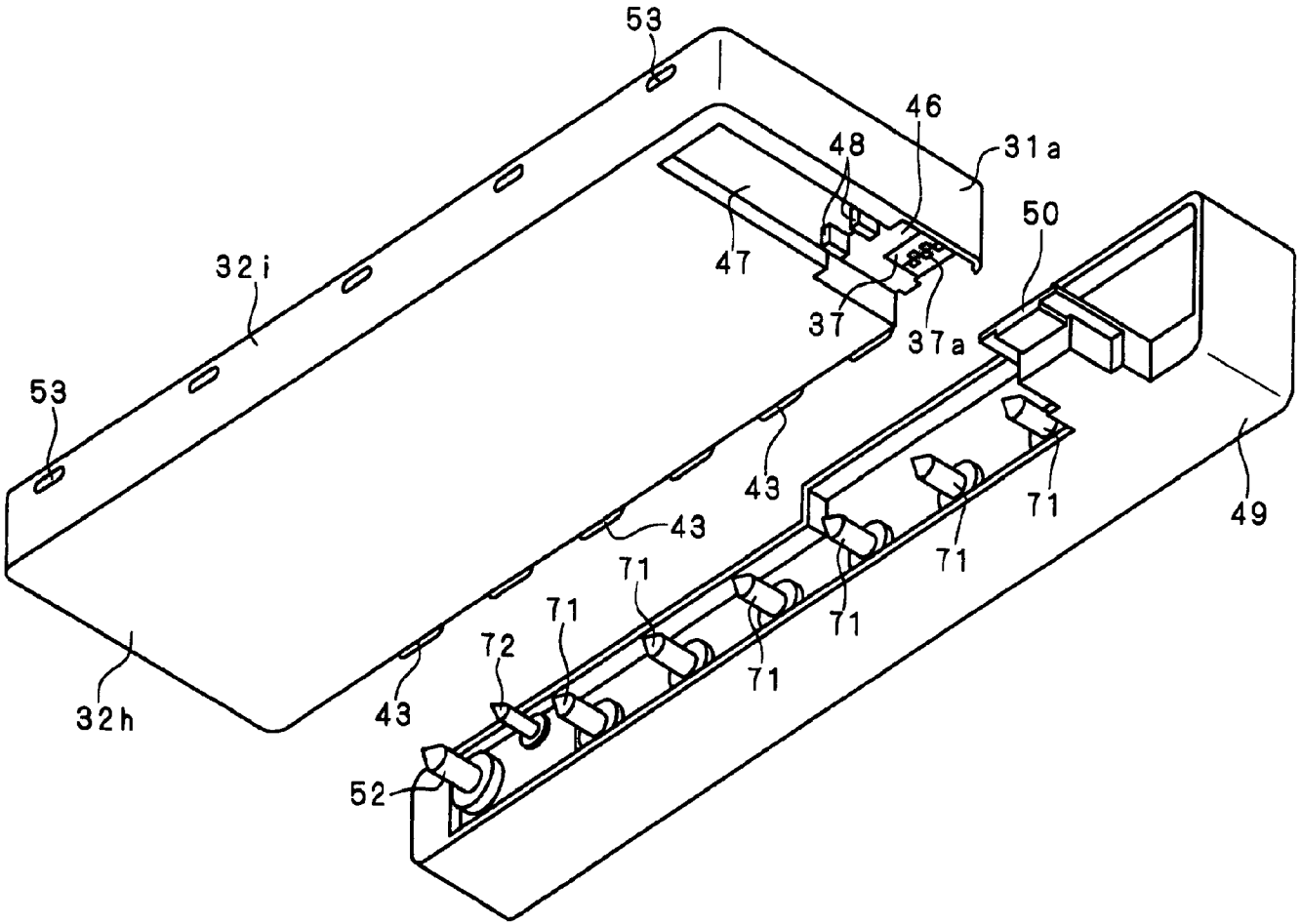
FIG. 6 is a main part perspective view showing a relation of the ink cartridge and a connection portion before connection.
Figure 7:
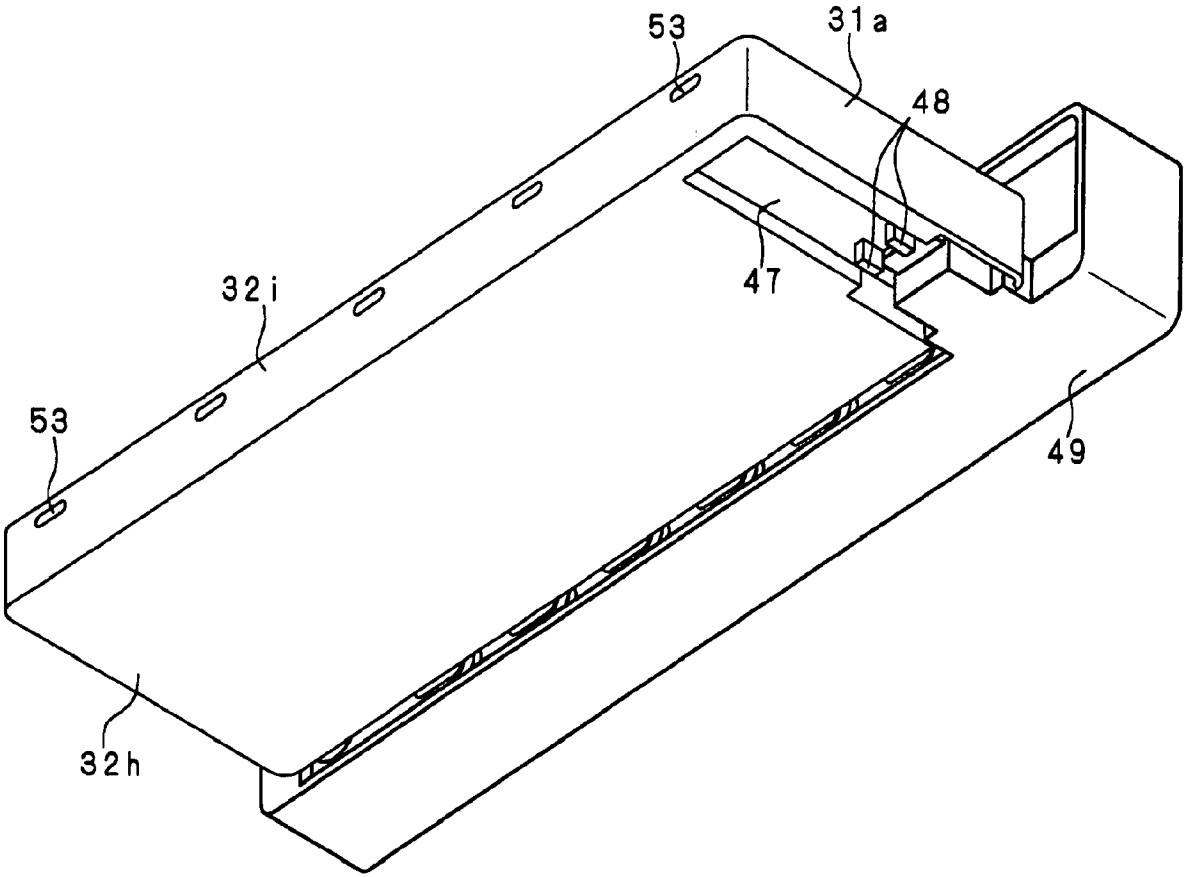
FIG. 7 is a main part perspective view showing a state in which the ink cartridge and the connection portion are connected.

Therefore, as shown in FIGS. 6 and 7, in the case in which the ink cartridge 14 is inserted in a connecting portion 49 arranged in the cartridge inserting portion 13 provided in the frame 12 of the printer 11, the connection terminals 37*a* are brought into electrical connection with a terminal mechanism (not shown) formed in a terminal disposing portion 50 of the connecting portion 49. Then, exchange of data such as types, remaining amounts, serial numbers, and usable periods of ink is executed from the semiconductor storage device via these connection terminals 37*a*.

Figure 5:
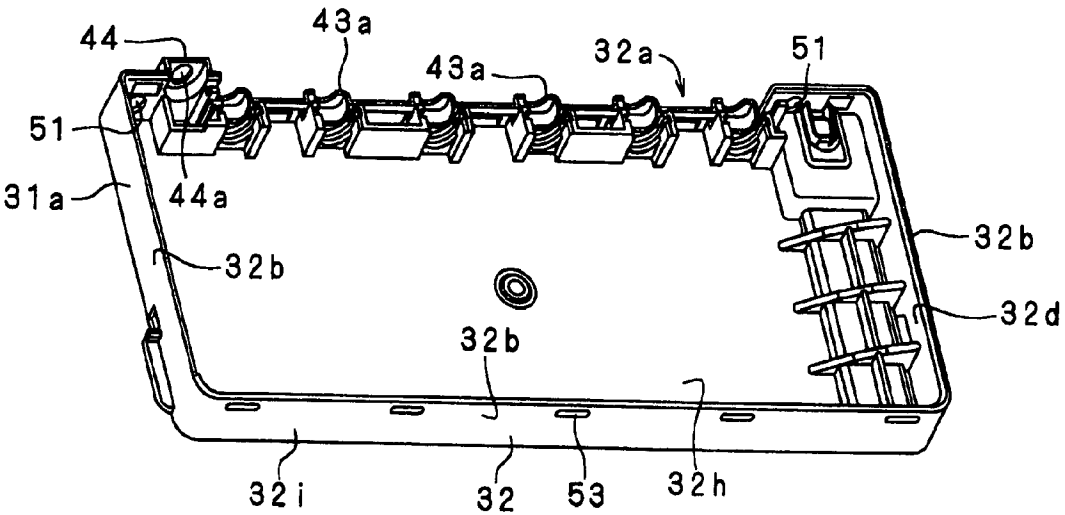
FIG. 5A is a perspective view showing the inside of a case main body portion.
FIG. 5B is a perspective view showing the outside of the case main body portion.
Figure 5:
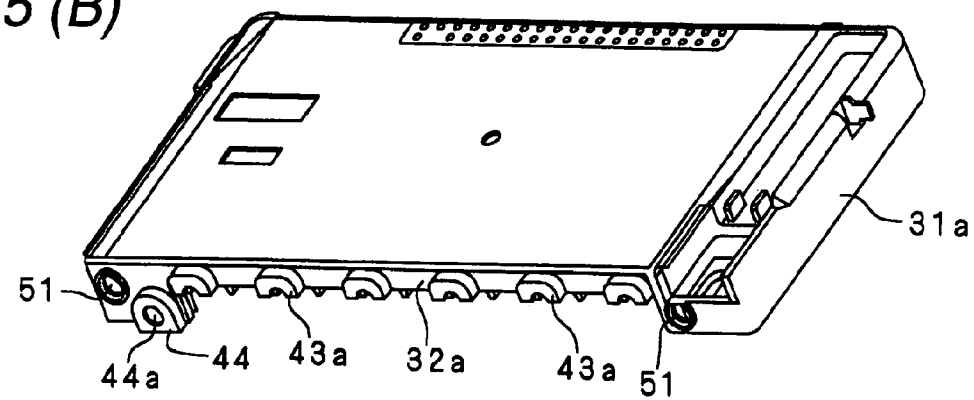

As shown in FIG. 6, a groove portion 47 is recessed toward a rear surface 32*i* side on the right of the bottom surface 32*h* of the case main body portion 32 so as to be continuous to the board accommodating recess 46. This groove portion 47 is formed shallower than the board accommodating recess 46 and ends before reaching the rear surface 32*i* from the board accommodating recess 46. Two projections 48 are formed to project downward on the board accommodating recess 46 side of the groove portion 47. Further, as shown in FIGS. 4A and 5A, engaging holes 53 for engaging the case main body portion 32 with the lid case 33 are provided on the rear surface 32*i*.

As shown in FIGS. 8A to 8C and FIG. 11, the lid case 33 includes a substantially rectangular plate-like portion 33*a* and an inner frame portion 45 serving as a wall member that erected at a right angle in a shape of a frame from the plate-like portion 33*a* in a position further on the inner side than the periphery of the plate-like portion 33*a*. Further, as shown in FIG. 12, the inner frame portion 45 includes four side surfaces, that is, a first side surface 45*a*, a second side surface 45*b*, a third side surface 45*c*, and a fourth side surface 45*d*. As described above, the outer side surface 45*e* of the inner frame portion 45 is set as a sliding abutment surface.

In FIG. 12, a through-hole 62 communicating the inside and the outside of the first side surface 45*a* is formed near a first corner portion 61 formed by the first side surface 45*a* and the fourth side surface 45*d* of the inner frame portion 45. In addition, the cylindrical waste ink introducing portion 44*b* is protrudingly provided from the outer side surface of the first side surface 45*a* so as to surround the through-hole 62.

Figure 11:
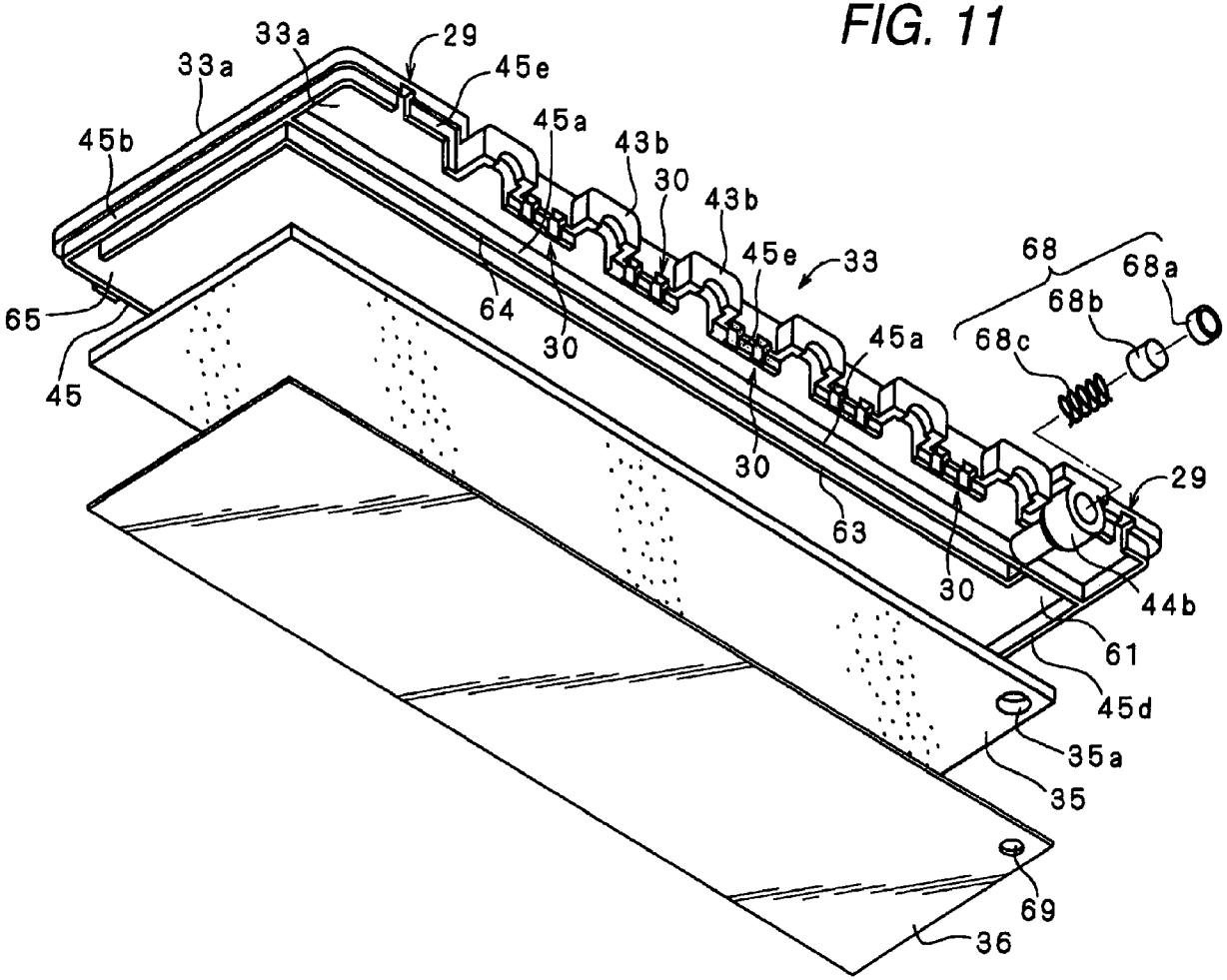
FIG. 11 is a disassembled perspective view of the lid case of the ink cartridge viewed from below.
Figure 12:
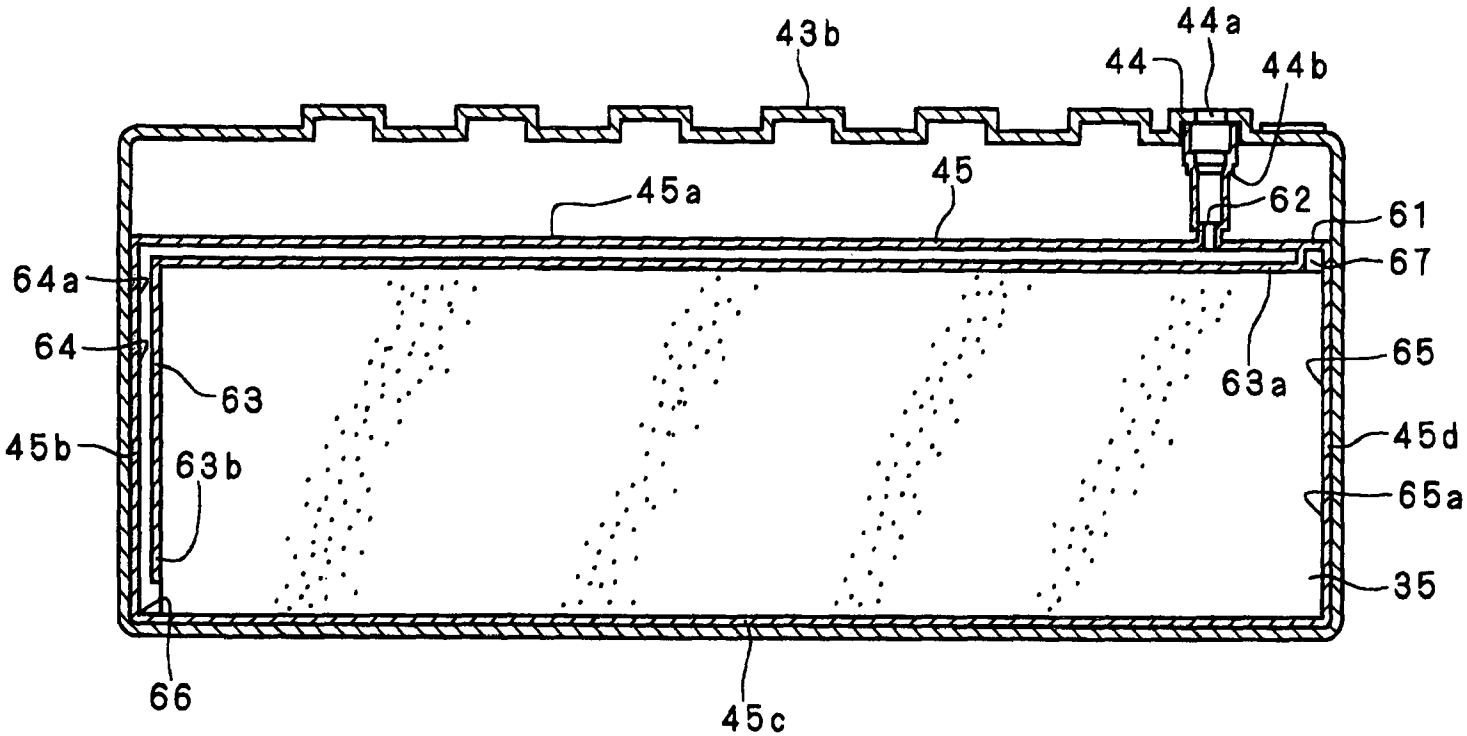
FIG. 12 is a plan view of the lid case of the ink cartridge.

As shown in FIG. 11, a valve device 68 is provided in the inside of the waste ink introducing portion 44*b*. This valve device 68 includes a valve seat 68*a* formed of an elastic member such as tubular rubber, a substantially columnar valve body 68*b*, and a spring 68*c*. These are arranged in an order of the valve seat 68*a*, the valve body 68*b*, and the spring 68*c* from the upstream to the downstream in the waste ink introducing portion 44*b*. In a state in which no force is applied from the outside, the valve body 68*b* is biased by the spring 68*c* so as to come into abutment against the valve seat 68*a* to bring the valve device 68 into a closed state.

As shown in FIGS. 11 and 12, in the inside of the inner frame portion 45, the lid case 33 includes a wall portion 63 serving as a wall surface formed in a "L" shape so as to be parallel with the first side surface 45*a* and the second side surface 45*b*. Note that a height of this wall portion 63 is set the same as a height of the inner frame portion 45. Therefore, a groove 64 is sectioned and formed between this wall portion 63 and the first and the second side surfaces 45*a* and 45*b*. In addition, a waste ink storing portion 65 of substantially a rectangular parallelepiped shape is sectioned and formed between the wall portion 63 and the third and the fourth side surfaces 45*c* and 45*d*.

The wall portion 63 is joined with the first side surface 45*a* at one end 63*a* thereof in a position closer to the first corner portion 61 than a position of the through-hole 62. In addition, the other end 63*b* of the wall portion 63 is located so as not to be in contact with the inner frame portion 45 in a second corner portion 66 formed by the second side surface 45*b* and the third side surface 45*c*. Therefore, the groove 64 communicates with the through-hole 62 near the first corner portion 61 and communicates with the waste ink storing portion 65 near the second corner portion 66 opposed to the first corner portion 61. As a result, in the case in which waste ink flows in via the through-hole 62, the waste ink moves through the groove 64 along the first side surface 45*a* and the second side surface 45*b* and flows into the waste ink storing portion 65 in the second corner portion 66.

A waste ink absorbing material 35 is contained in the waste ink storing portion 65. The waste ink absorbing material 35 is formed of a porous material, and as shown in FIG. 11, has a rectangular parallelepiped shape and has a size and a thickness just enough for fitting in the inside of the waste ink storing portion 65.

Note that, in the waste ink storing portion 65, a rectangular space 67, which is formed by the wall portion 63 near the first corner portion 61, is formed in the waste ink storing portion 65. The waste ink absorbing material 35 is not interposed in this space 67.

In FIG. 11, a film 36 has a rectangular shape and is formed of, for example, polyolefin or PET. The film 36 is thermally fusion-welded to the inner frame portion 45 and the wall portion 63 in a peripheral part thereof to thereby seal the inside of the inner frame portion 45.

Therefore, an opening of the groove 64 is sealed by the film 36, whereby a flow path 64*a* serving as a waste liquid flow path with a closed section is formed. In addition, an opening of the waste ink storing portion 65 is sealed by the film 36 in a state in which the waste ink absorbing material 35 is contained, whereby a waste ink storing chamber 65*a* serving as a waste liquid collecting portion is formed.

As shown in FIG. 11, the film 36 includes an air hole 69 in a position opposed to the through-hole 35*a* of the waste ink absorbing material 35. Consequently, excess air in the waste ink storing chamber 65*a* formed by the waste ink storing portion 65 and the film 36 can be discharged to the outside.

Figure 8:
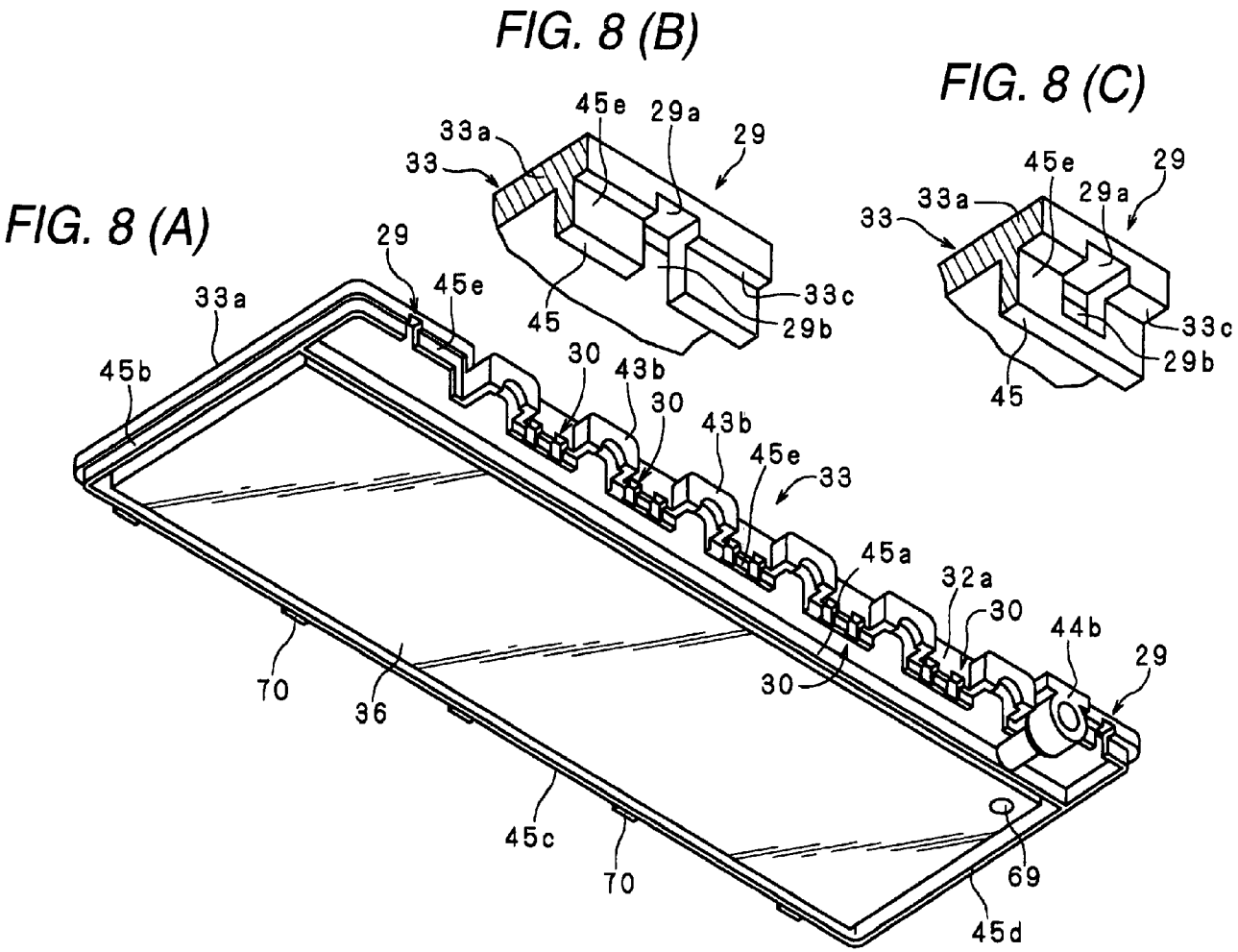
FIG. 8A is a perspective view of a lid case of the ink cartridge viewed from below.
FIGS. 8B and 8C are partial enlarged views of the lid case of the ink cartridge viewed from below.

On the other hand, as shown in FIG. 8A, engaging portions 70 are provided on a rear surface of the lid case 33 and engage with the engaging holes 53 to fix the lid case 33 to the case main body portion 32 integrally.

Next, the connecting portion 49, which is provided in the cartridge inserting portion 13 and connected to the ink cartridge 14 when the ink cartridge 14 is inserted in the cartridge inserting portion 13 provided in the frame 12 of the printer 11, will be explained. FIG. 6 is a main part perspective view showing a relation between the ink cartridge 14 and the connecting portion 49, and FIG. 7 is a main part perspective view showing a state in which the ink cartridge 14 is connected to the connecting portion 49.

In FIG. 6, the connecting portion 49 is provided with positioning pins 52 (only one positioning pin is shown) at both ends on a front surface thereof. The positioning pins 52 is fit and inserted in the positioning holes 51 (see FIG. 2) provided in the ink cartridge 14 to position and fix the ink cartridge 14 when the ink cartridge 14 and the connecting portion 49 are connected.

Six liquid introducing members 71 and one introducing and communicating portion 72, which correspond to the six supporting portions 43 and the one waste ink collecting port 44*a* of the ink cartridge 14, are provided between the pair of positioning pins 52 of the connecting portion 49.

The six liquid introducing members 71 are provided in positions corresponding to the positions of the support portions 43 of the ink cartridge 14, respectively, when the ink cartridge 14 is fixed to the connecting portion 49. Tips of the liquid introducing members 71 are formed in a needle shape such that the liquid introducing members 71 can be fit and inserted in the ink leading members 42 of the ink packs 34 supported by the support portions 43. In other words, the liquid introducing members are the ink supply needles 71. In the six liquid introducing members 71, not-shown through-holes, which lead ink from the ink cartridge 14 to the ink supply tube 19, are pierced and formed, respectively.

The introducing and communicating portion 72 is provided in a position corresponding to a position of the waste ink collecting port 44*a* of the ink cartridge 14 when the ink cartridge 14 is fixed to the connecting portion 49. A tip of the introducing and communicating portion 72 is formed in a needle shape such that the introducing and communicating portion 72 can be fit and inserted in the waste ink introducing portion 44*b* via the waste ink collecting port 44*a*. In this introducing and communicating portion 72, a not-shown through-hole, which introduces ink sucked by the suction pump 24 and discharged from the waste ink tube 23 into the ink cartridge 14 (waste ink storing chamber 65*a*), is pierced and formed.

A terminal disposing portion 50 is formed to extend forward in a right lower part of the connecting portion 49 in FIGS. 6 and 7. The terminal disposing portion 50 includes a terminal mechanism (not shown), and as shown in FIG. 7, when the ink cartridge 14 is inserted, the terminal disposing portion 50 is slid from the opening of the board accommodating recess 46 of the case main body portion 32, and the terminal mechanism is electrically connected to the connection terminal 37*a* of the circuit board 37.

Next, a procedure for storing the ink packs 34 in the container case 31 and an action with which ink is supplied from the ink cartridge 14 will be explained.

As shown in FIG. 4A, the ink packs 34 are stored in the case main body portion 32. In this case, the six ink packs 34 are stored in a state in which a half of one ink pack 34 is laid on top of a half of another ink pack 34. The projected rim portions 26 of the ink leading members 42 are fit into the groove portions 25, and the ink introducing members 42 are fixed in the support portions 43.

When the lid case 33 is fit in the case main body portion 32, the lid case 33 is brought close to the case main body portion 32 in a depth direction of the case main body portion 32, the outer side surface 45*e* of the inner frame portion 45 is gradually fitted in the inner side surface 32*d* of the sidewall plate 32*b* while being slid, and the attachment of the lid case 33 is completed when the lower surface 33*c* of the plate-like portion 33*a* comes into abutment against the top surface 32*c* of the sidewall plate 32*b*. Note that, in this state in which the attachment of the lid case 33 is completed, the engaging portions 70 of the lid case 33 elastically fit in the engaging holes 53 of the case main body portion 32 to secure integrity as the container case 31.

The ink cartridge 14 is inserted in the cartridge inserting portion 13 with side portions of the container case 31 as guides. First, the positioning holes 51, which are provided near both the ends of the front surface 32*a* of the case main body portion 32, are guided to the positioning pins 52 provided near both the ends of the connecting portion 49. The positioning pins 52 and the positioning holes 51 fit with each other, whereby a position of the ink cartridge 14 is fixed. In this case, the ink supply needles 71 of the connecting portion 49 are inserted in the respective support portions 43 of the ink cartridge 14, that is, the ink supply ports 42*a* of the ink packs 34, whereby the valve mechanism (not shown) in the ink supply ports 42*a* open. In addition, the introducing and communicating portion 72 of the connecting portion 49 is inserted into the waste ink introducing portion 44*b* via the waste ink collecting portion 44*a* of the ink cartridge 14, whereby the valve device 68 in the waste ink introducing portion 44*b* opens.

Therefore, it becomes possible to supply the ink in the respective ink packs 34 contained in the ink cartridge 14 to the recording head 17 via the ink supply tubes 19, and it also becomes possible to introduce ink discharged from the waste ink tube 23 into the waste ink storing chamber 65*a*.

Further, the terminal mechanism (not show) of the terminal disposing portion 50 is electrically connected to the connection terminals 37*a* of the circuit board 37 provided in the board accommodating recess 46 of the ink cartridge 14. Consequently, the printer 11 can acquire data such as types, remaining amounts, serial numbers, and usable periods of ink stored in the semiconductor storing means mounted on the circuit board 37 and can rewrite the data.

Subsequently, a structure for controlling flow of ink leaked from a connection part between the ink cartridge 14 and the connection portion 49 will be explained.

When the ink cartridge 14 is detached from the connecting portion 49, ink leakage occurs because the surfaces of the exposed ink supply needles 71 are wet with ink or a slight amount of ink scatters in a transition period of the detachment of the ink cartridge. If a user repeats such detachment and attachment of the ink cartridge for a more number of times than normal, the ink leaked as described above accumulates to an amount enough for allowing the ink to flow. Then, the ink flows in a gap part between the fitting portions of the case main body portion 32 and the lid case 33 due to the capillarity to reach a place apart from the support portions 43.

As described above, as shown in FIGS. 2A to 2C, FIG. 3, and FIGS. 4A and 4B, the vertical direction in the figures is set as a depth direction of the case. The container case 31 is formed in a state in which the lid case 33 fits in the case main body portion 32. In other words, as shown in FIG. 2B, which is a sectional view along line (B)-(B) in FIG. 2A, and FIG. 2C, which is a sectional view along line (C)-(C) in FIG. 2A, the top surface 32*c*, which is one abutment surface, is provided on the sidewall plate 32*b* of the case main body portion 32. In addition, the lower surface 33*c*, which is another abutment surface, is provided in the peripheral part of the plate-like portion 33*a* of the lid case 33.

The inner surface 32*d* of the sidewall plate 32*b* is set as one sliding abutment surface, and the outer surface 45*e* of the inner frame portion 45, which is formed in a state in which the inner frame portion 45 is erected along the vicinity of the outer periphery of the lid case 33, is set as another sliding abutment surface.

As shown in FIG. 2, the fitting portion where the lid case 33 fits in the case main body portion 32 is constituted by an abutment fitting portion 27 and a slide fitting portion 28. The abutment fitting portion 27 is formed in a relation in which the top surface 32*c* on the case main body portion 32 side and the lower surface 33*c* on the lid case 33 side are in surface abutment. On the other hand, the slide fitting portion 28 is formed in a relation in which the outer side surface 45*e* of the inner frame portion 45 on the lid case 33 side and the inner surface 32*d* of the sidewall plate 32*b* on the case main body portion 32 side are in surface contact while sliding with respect to each other.

As described above, the fitting relation between the case main body portion 32 and the lid case 33 is formed according to a composite structure of the abutment fitting portion 27 and the slide fitting portion 28.

The abutment fitting portion 27 and the slide fitting portion 28 look as if there is no gap between the abutment fitting portion 27 and the slide fitting portion 28 externally. However, actually, since there is slight unevenness on the top surface 32*c*, the lower surface 33*c*, the inner side surface 32*d*, and the outer side surface 45*e*, respectively, some contact portions of the surfaces are partially in contact and the other contact portions are in a state of a gap. Therefore, the capillarity of ink occurs in portions in the state of a gap, and the ink flow as described above occurs.

In order to prevent the ink flow, space portions 29 with a gap larger than the gap between the abutment fitting portion 27 and the slide fitting portion 28 is formed in a position apart from the support portions 43, whereby ink having flown through the fitting portions 27 and 28 is stored in the space portions 29, and the ink flow is prevented in the space portions 29.

Figure 10:
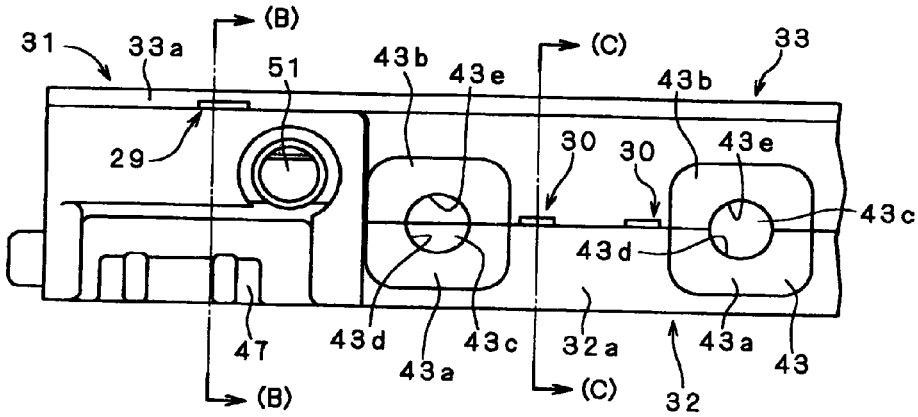
FIG. 10A is a front view of a container case.
FIGS. 10B and 10C are partial sectional views of the container case.
Figure 10:
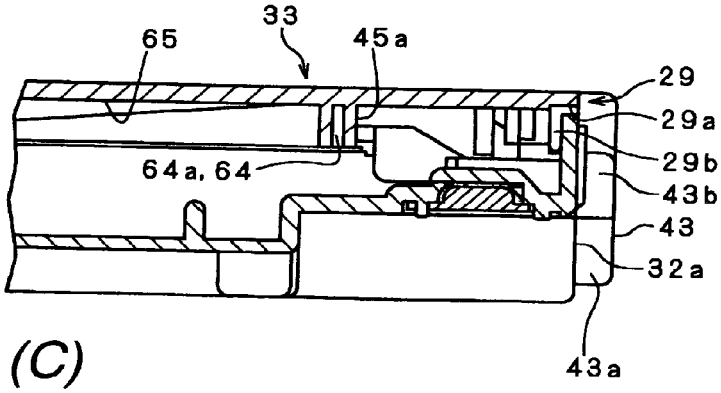
Figure 10:
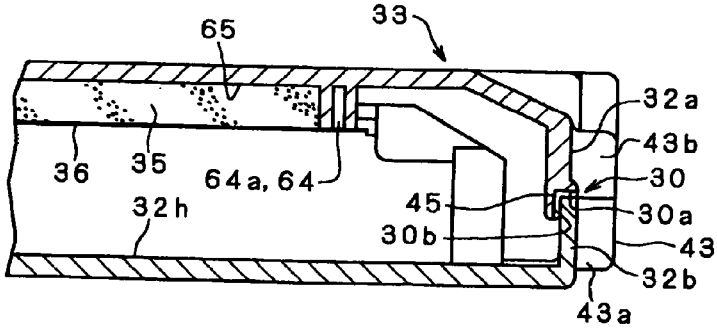

The space portion 29 shown in FIG. 8B is formed between an end of the front surface 32*a* of the container case 21, that is, a corner part (a ridge part of the corner part), which is formed by the front surface 32*a* and a lateral side surface 31*a* continuing the front surface 32*a*, and the support portion 43 arranged in the place closest to the end. The space portion 29 in this place is formed in a state in which a recess 29*a* provided in the plate-like portion 33*a* of the part set as the lower surface 33*c* and a pierced portion 29*b* formed by cutting out the inner frame portion 45 are continuous as a space. A sectional state of the space portion 29 formed by the recess 29*a* and the pierced portion 29*b* is shown in FIG. 10B. A depth direction of the recess 29*a* is set in a direction opposite to the depth direction of the case main body portion 32. In addition, as shown in FIG. 8C, the pierced portion 29*b* can be formed as a pierced space of a square window hole shape.

As shown in FIGS. 2A, 8A, and 10B, the space portions 29 are arranged near left and right ends of the front surface 32*a* of the container case 31. Therefore, flow of ink having flown through the abutment fitting portion 27 and the slide fitting portion 28 is prevented in the left and right two space portions 29 and never flows to the lateral side surface 31*a* side of the container case 31. Note that the space portion 29 can be formed only by the recess 29*a* or can be formed only by the pierced portion 29*b*.

Figure 9:
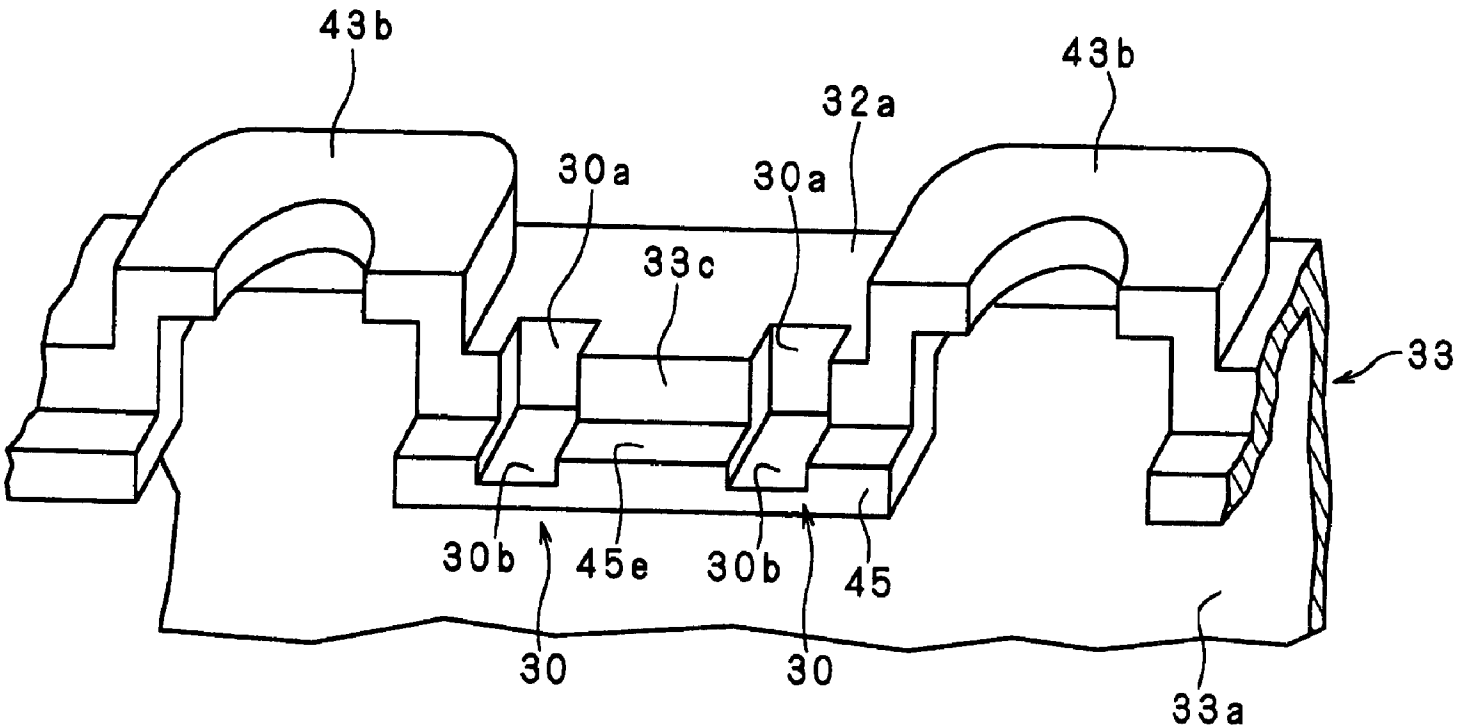
FIG. 9 is an enlarged perspective view of a part of a space portion of the lid case.

On the other hand, as shown in FIGS. 2A, 8A, 9, and 10C, space portions 30 are arranged in left and right positions of the respective support portions 43. Places where the space portions 30 are provided are the lower surface 33*c* on the lid case 33 side and the outer side surface 45*e* of the inner frame portion 45 as shown in FIG. 9 in an enlarged fashion. A recess 30*a* formed on the lower surface 33*c* has a depth in a direction opposite to the depth direction of the case main body portion 32. In addition, a recess 30*b* formed on the outer side surface 45*e* has a depth in a direction substantially perpendicular to the depth direction of the case main body portion 32. Both the recesses 30*a* and 30*b* are formed as spaces communicating with each other. A sectional state of the parts of the space portions 30 is shown in FIG. 10C.

Although the two space portions 30 are arranged between the adjacent support portions 43, only one space portion 30 may be provided. In the case in which the one space portion 30 is provided, it is desirable to set a space volume, which is obtained by the recesses 30*a* and 30*b*, large. Note that the space portion 30 can be formed only by the recess 30*a* or can be formed only by the recess 30*b*. In addition, the recess 30*b* can be implemented in a form of a pierced space of a square window hole shape as shown in FIG. 8C.

Gap dimensions of the space portions 29 and 30 are set appropriately according to physical properties of ink such as viscosity and surface tension.

Figure 13:
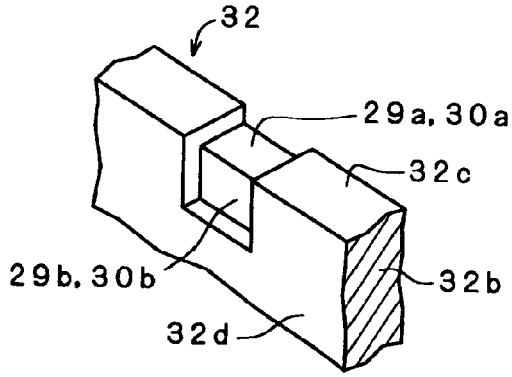
Figure 13:
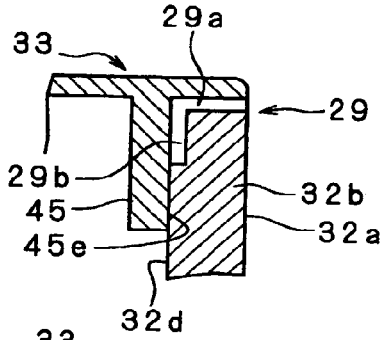
Figure 13:
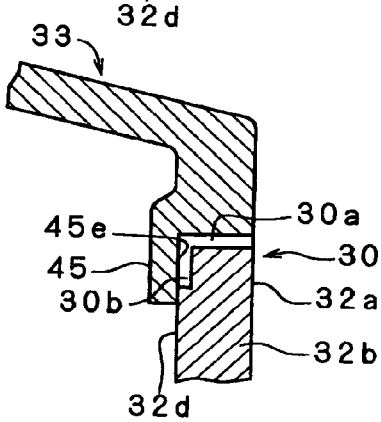
Figure 13:
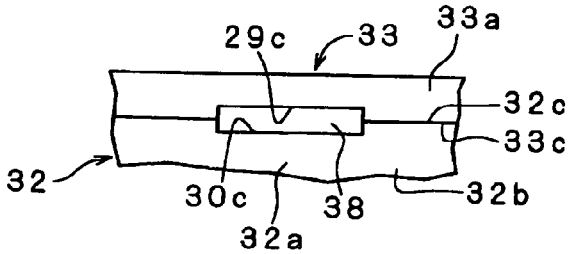

In the above-mentioned embodiment, the recesses 29*a*, 30*a*, 30*b*, and the like are formed on the lid case 33 side. However, as shown in FIG. 13, these can be formed on the case main body portion 32 side. In FIG. 13, the same portions as those in the embodiment described above are denoted by the same reference numerals and signs.

Moreover, as shown in FIG. 13D, it is also possible to form the recesses 30*c* and 29*c* in both the top surface 32*c* and the lower surface 33*c* to form one space portion 38 with both the recesses 30*c* and 29*c*. Formation of one space portion with two recesses can also be carried out between the outer side surface 45*e* of the inner frame portion 45 and the inner side surface 32*d* of the sidewall plate 32*b*.

Note that, in the case in which ink drips or scatters from the respective support portions 43, the dripped or scattered ink does not flow and adhere on the circuit board 37. The circuit board 37 provided in the board accommodating recess 46 is attached at a height equal to or higher than the center line L1 of the support portions 43 (ink supply ports 42*a*) and attached in a position perpendicular to the front surface 32*a* of the ink cartridge 14. Therefore, the dripped ink or the like never flows to the circuit board 37.

In addition, in the case in which ink drips or scatters from the waste ink collecting port 44*a*, it is not likely that the dripped or scattered ink flows and adheres to the circuit board 37. The circuit board 37 provided in the board accommodating recess 46 is attached on a side opposite to a position where the waste ink collecting port 44*a* is provided. Therefore, the dripped ink never flows to the circuit board 37.

Actions and advantages obtained by the embodiment are as described below.

Even if ink, that has flown from a place where the ink supply needles 71 on the cartridge inserting portion 13 side and the ink leading member 42 on the ink cartridge 14 side fit, flows through the fitting portions 27 and 28 due to the capillarity, the ink is stored in the space portions 29 and 30 formed of gaps larger than the gaps of the fitting portions 27 and 28. The ink takes on the capillarity in a gap part having an enlarged space volume even in this storing phenomenon and comes into a state in which the ink is retained in the space portions 29 and 30. Therefore, the flow of the ink in the fitting portions 27 and 28 is stopped in the places in the space portions 29 and 30, and ink flow to the fitting portions 27 and 28 further extending from the space portions 29 and 30 is prevented. According to such a phenomenon of ink flow prevention, ink smear of the ink cartridge 14 can be restrained within a minimum range, and when the ink cartridge 14 is attached to or detached from the cartridge inserting portion 13, a hand is prevented from being smeared with the ink.

The space portion 29 is provided between the end of the front surface 32*a* of the container case 31 and the support portion 43 present in a place closest to the end, whereby flow of ink in the fitting portions 27 and 28 is prevented in the space portion 29 arranged within the range of the front surface 32*a* of the container case 31. Therefore, the ink is prevented from flowing to, for example, the place of the lateral side surface 31*a* of the container case 31 exceeding the range of the front surface 32*a*.

The space portions 29 are provided near both the ends of the front surface 32*a* of the container case 31, respectively, whereby, even in a structure in which a plurality of the support portions 43 are arranged on the front surface 32*a* of the container case 31, flow of ink near both the ends of the front surface 32*a* is prevented, and the ink is prevented from flowing to, for example, the place of the lateral side surface 31*a* of the container case 31 exceeding the range of the front surface 32*a*.

The plural support portions 43 are provided in line on the front surface 32*a* of the container case 31, and the plural ink packs 34 are contained in the container case 31 in association with the respective support portions 43. Consequently, the ink leading members 42 of the plural ink packs 34 contained in the container case 31 are positioned by the arranged support portions 43. Thus, the plural ink packs 34 comes into a state in which the ink packs 34 are arranged regularly in the container case 31, loads of the other ink packs 34 never concentrate on a specific ink pack 34, ink supply from the respective ink packs 34 can be made uniform. At the same time, even in the case in which ink of plural colors leaks, ink flow along the fitting portions 27 and 28 is prevented in the space portions 29 and 30.

The space portions 30 are provided on both the side of the support portion 43, respectively, whereby the space portions 30 can be arranged in places closer from the support portion 43 to reduce a flowing range of ink flowing through the fitting portions 27 and 28 to a minimum limit.

A fitting direction of the fitting portions 27 and 28 is set substantially in the depth direction of the case main body portion 32, and gap dimensions of the space portions 29 and 30 are set to be larger than gap dimensions of the fitting portions 27 and 28 as viewed in the fitting direction. Thus, gaps of the space portions 29 and 30 can be secured in the fitting direction, and arrangement of the space portions 29 and 30 suitable for a fitting structure of the fitting portions 27 and 28 becomes possible.

A fitting direction of the fitting portions 27 and 28 is set substantially in the depth direction of the case main body portion 32, and gap dimensions of the space portions 29 and 30 are set to be larger than gap dimensions of the fitting portions 27 and 28 as viewed in a direction substantially perpendicular to the fitting direction. Thus, since gaps of the space portions 29 and 30 can be secured in a direction perpendicular to the fitting direction, arrangement of the space portions 29 and 30 suitable for a fitting structure of the fitting portions 27 and 28 becomes possible.

Since the space portions 29 and 30 are formed with the recesses 29*a*, 30*a*, and 30*b* provided in a part of the case main body portion 32 and/or the lid case 33 of the fitting portions 27 and 28, a degree of freedom of recess formation with respect to the case main body portion 32 or the lid case 33 is increased, whereby optimum space portion formation according to a behavior of ink flowing through the fitting portions 27 and 28 can be performed.

The space portions 29 and 30 are formed by the pierced portion 29*b* provided in the inner frame portion 45 forming a part of the fitting portions 27 and 28. Thus, an ink retaining function can be imparted to a space formed by the pierced portion 29*b*, and formation of the space portions 29 and 30 can be performed under a high degree of freedom according to a flowing behavior of ink.

The support portion 43 is constituted by fitting the lower support portion 43*a* formed on the case main body portion 32 side and the upper support portion 43*b* formed on the lid case 33 side, the reception opening 43*c*, which is formed in a front surface part of the support portion 43 and receives the liquid introducing member 71, is provided, and the fitting portions 27 and 28 are arranged so as to traverse the reception opening 43*c*. Consequently, the support portion 43 and the reception opening 43*c* are formed by fitting the lid case 33 with the case main body portion 32. Thus, this is effective for simplification of a structure. In addition, the fitting portions 27 and 28, which are secants of the case main body portion 32 and the lid case 33, traverse the reception opening 43*c*. Thus, the fitting portions 27 and 28 are present near a place where ink scatters in a form of spray or the like, the ink can be flown in the fitting portions 27 and 28 surely, and as a result, the flow can be prevented in the space portions 29 and 30 leading to the fitting portions 27 and 28.

Since the ink pack 34 is a pack constituted by a film material having flexibility, a pack of a bag shape, which is easily deformed by a weight of ink, can be contained in the ink cartridge 14 surely.

As explained above, according to this embodiment, the following advantages can be further obtained.

(1) Concerning the ink cartridge 14, since the circuit board 37 is arranged at one end on the opposite side of the waste ink collecting port 44*a*, in the case in which ink dripping or scattering occurs around the waste ink collecting port 44*a*, influence to the circuit board 37 can be avoided.

(2) Concerning the ink cartridge 14, the circuit board 37 is disposed in the board accommodating recess 46 such that the circuit board 37 is attached at a height equal to or higher than the center line L1 of the support portions 43 (ink supply ports 42*a*) when the ink cartridge 14 is connected to the connecting portion 49. Therefore, in the case in which ink dripping or scattering occurs around the support portion 43, influence to the circuit board 37 can be avoided.

(3) Concerning the ink cartridge 14, the circuit board 37 is provided in a position perpendicular to the support portions 43 or the formed surface of the waste ink collecting port 44*a* provided in the ink cartridge 1. Therefore, in the case in which ink dripping or scattering occurs around the support portions 43 or the waste ink collecting port 44*a*, influence to the circuit board can be avoided.

(4) Concerning the ink cartridge 14, the positioning holes 51 are provided near the board accommodating recess 46 (circuit board 37) and near the waste ink collecting port 44*a*, that is, on both the sides of the ink cartridge 14, respectively. Therefore, balance of loads in inserting the ink cartridge 14 into the printer 11 (connecting portion 49) is made uniform. As a result, the ink cartridge 14 can be inserted stably while a direction for inserting the ink cartridge 14 is kept constant. In addition, the terminal mechanisms of the circuit board 37 and the terminal disposing portion 50 on the main body side are connected accurately.

(5) Concerning the ink cartridge 14, since the support portions 43 are arranged in the central part of the front surface 32*a*, in the state in which only the waste ink collecting port 44*a* is present at one end, an insertion load at the time when the ink cartridge 14 is inserted into the printer is applied only to the waste ink collecting port 44*a* side. However, in this embodiment, the circuit board 37 is arranged at one end on the opposite side of the waste ink collecting port 44*a* across the support portions 43, whereby an overall balance is improved by a load at the time when the connection terminals 37*a* is connected to a connection mechanism.

(6) Although the waste ink collecting port 44*a* is formed in the case main body portion 32, the waste ink introducing portion 44*b*, into which the introducing and communicating portion 72 of the connecting portion 49 is inserted and engaged, is formed in the lid case 33. On the other hand, the circuit board 37 is mounted on the case main body portion 32. Since a portion in which ink leakage is likely to occur (the waste ink introducing portion 44*b*) and a member that should be protected from ink (the circuit board 37) are provided in the lid case 33 and the case main body portion 32, which are separate members, respectively, even if ink leakage occurs in the waste ink introducing portion 44*b*, likelihood of the ink flow to the circuit board 37 can be reduced remarkably.

Note that the embodiment of the invention may be changed as described below.

Although there are the six ink packs 34 to be contained in the embodiment, the number is not limited specifically. For example, the number may be 1 to 5 or 7 or more.

The embodiment is explained using the structure in which the semiconductor storing means and the connecting terminals 37*a* are provided in the plate-like circuit board 37. However, a structure may be adopted in which an FPC (flexible print board) is used, a connection terminal is provided at one end thereof, and semiconductor storing means connected to this connection terminal is provided at the other end to arrange the connection terminal in the board accommodating recess 46 arrange the other end where the semiconductor storing means is provided on another sidewall of the case main body.

The above-mentioned respective embodiments concern the ink-jet type printer. However, the liquid ejection apparatus mounted with the ink cartridge obtained by the invention does not concern only ink for the ink-jet type printer but can eject glue, manicure, conductive liquid (liquid metal), and the like.

Moreover, the ink-jet type printer using ink, which is a form of liquid, is explained in the embodiments. However, it is also possible to apply the invention generally to liquid ejection heads that discharge liquid such as a recording head used in an image recording apparatus like a printer, a facsimile, or a copier, a color material ejection head that is used for manufacturing of color filters for a liquid crystal display or the like, an electrode material ejection head that is used for electrode formation like an organic EL display or an FED (Field Emission Display), an organic ejection head used for biochip manufacturing, and a sample ejection head for a precision pipette.

What is claimed is:

1. A liquid container adapted to be detachably mounted on a liquid ejecting apparatus, the liquid container comprising:

a container body having a first side in a first direction and a second side in a second direction, the first side being longer than the second side, the first direction being perpendicular to the second direction, the container body including a first surface and a second surface being different from the first surface:

a waste liquid collecting portion configured to collect waste liquid from the liquid ejection apparatus when the liquid container is mounted on the liquid ejecting apparatus;

a plurality of supply ports each of which is configured to supply liquid to the liquid ejection apparatus when the liquid container is mounted on the liquid ejecting apparatus, the supply ports being provided on the first surface and configured to be arrayed in the first direction; and a circuit board mounting thereon storing means and configured to be disposed on the second surface at a position equal to or higher than a central axis of each of the supply ports when the liquid container is mounted on the liquid ejection apparatus.

2. The liquid container according to claim 1, wherein;

the circuit board has a terminal electrically connected to the storing means and configured to be connected to a terminal provided in the liquid ejection apparatus when the liquid container is mounted on the liquid ejection apparatus; and the terminal of the circuit board is configured to face downward when the liquid container is mounted on the liquid ejection apparatus.

3. The liquid container according to claim 2, wherein the second surface is disposed in a recess.

4. A liquid container adapted to be detachably mounted on a liquid ejection apparatus, the liquid container comprising:

a container body having a first side in a first direction and a second side in a second direction, the first side being longer than the second side, the first direction being perpendicular to the second direction, the container body including a side surface:

a plurality of supply ports each of which is configured to supply liquid to the liquid ejection apparatus when the liquid container is mounted on the liquid ejecting apparatus, the supply ports being provided on the side surface and forming a supply port array which is configured to be arrayed in the first direction;

a circuit board mounting thereon a storage device, the circuit board being disposed at a first side of the supply port array;

a waste liquid collecting portion configured to collect waste liquid from the liquid ejection apparatus when the liquid container is mounted on the liquid ejection apparatus; and a waste liquid collecting port being in communication with the waste liquid collecting portion and disposed at a second side of the supply port array which is opposite to the first side.

5. The liquid container according to claim 4, further comprising a plurality of positioning holes configured to respectively receive positioning members provided in the liquid ejection apparatus when the liquid container is mounted on the liquid ejection apparatus, wherein one of the positioning holes is provided at a position closer to the waste liquid collecting port than any of the supply ports.

6. The liquid container according to claim 4, wherein the supply port array is arranged between the positioning holes, and the waste liquid collecting port and the circuit board are arranged outside the supply port array in the first direction.

7. The liquid container according to claim 4, wherein the circuit board is disposed in an inner surface of an accommodating recess that is recessed from the side surface and that is located on a bottom surface of the liquid container.

8. The liquid container according to claim 4, further comprising:

a plurality of liquid containing bags each containing liquid therein and having a leading member, wherein each of the supply ports is provided on a centerline of the side surface and supports the leading member, wherein, the circuit board is disposed at a position equal to or higher than a central axis of each of the supply ports when the liquid container is mounted on the liquid ejection apparatus.

9. The liquid container according to claim 8, wherein each of the liquid containing bags is made from two flexible films welded together to form four sides.

10. A liquid container adapted to be detachably mounted on a liquid ejection apparatus, the liquid container comprising:

a container body having a first side in a first direction and a second side in a second direction, the first side being longer than the second side, the first direction being perpendicular to the second direction, the container body including a side surface:

a plurality of supply ports each of which is configured to supply liquid to the liquid ejection apparatus when the liquid container is mounted on the liquid ejecting apparatus, the supply ports being provided on the side surface and forming a supply port array which is configured to be arrayed in the first direction;

a storage device disposed at a first side of the supply port array;

a connection terminal electrically connected to the storage device and configured to be connected to a terminal provided in the liquid ejection apparatus when the liquid container is mounted on the liquid ejection apparatus;

a waste liquid collecting portion configured to collect waste liquid from the liquid ejection apparatus when the liquid container is mounted on the liquid ejection apparatus; and a waste liquid collecting port being in communication with the waste liquid collecting portion and disposed at a second side of the supply port array which is opposite to the first side, wherein the supply port array is arranged between the waste liquid collecting port and the connection terminal.

11. The liquid container according to claim 10, further comprising a plurality of positioning holes configured to respectively receive positioning members provided in the liquid ejection apparatus when the liquid container is mounted on the liquid ejection apparatus, wherein one of the positioning holes is provided at a position closer to the waste liquid collecting port than any of the supply ports.

12. The liquid container according to claim 10, wherein the supply port array is arranged between the positioning holes, and the waste liquid collecting port and the connection terminal are arranged outside the supply port array in the first direction.

13. The liquid container according to claim 10, wherein the connection terminal is formed on an inner surface of an accommodating recess that is recessed from the side surface and that is located on a bottom surface of the liquid container.

14. A liquid container adapted to be detachably mounted on a liquid ejection apparatus, the liquid container comprising:

a container body having a first side in a first direction and a second side in a second direction, the first side being longer than the second side, the first direction being perpendicular to the second direction, the container body including a side surface;

a plurality of supply ports provided on the side surface and forming a supply port array which is configured to be arrayed in the first direction;

a connection terminal disposed at a first side of the supply port array and configured to be electrically connected to a terminal provided in the liquid ejection apparatus when the liquid container is mounted on the liquid ejection apparatus;

a waste liquid collecting portion configured to collect waste liquid from the liquid ejection apparatus when the liquid container is mounted on the liquid ejection apparatus; and a waste liquid collecting port being in communication with the waste liquid collecting portion and disposed at a second side of the supply port array which is opposite to the first side.

15. The liquid container according to claim 14, further comprising a plurality of positioning holes configured to respectively receive positioning members provided in the liquid ejection apparatus when the liquid container is mounted on the liquid ejection apparatus, wherein one of the positioning holes is provided at a position closer to the waste liquid collecting port than any of the supply ports.

16. The liquid container according to claim 14, wherein the supply port array is arranged between the positioning holes, and the waste liquid collecting port and the connection terminal are arranged outside the supply port array in the first direction.

17. The liquid container according to claim 14, wherein the connection terminal is formed on an inner surface of an accommodating recess that is recessed from the side surface and that is located on a bottom surface of a case main body constituting the liquid container.

* * * * *